US011060485B2

(12) United States Patent
Shirai et al.

(10) Patent No.: US 11,060,485 B2
(45) Date of Patent: Jul. 13, 2021

(54) CONTROL VALVE ASSEMBLY

(71) Applicant: HAMANAKODENSO CO., LTD., Kosai (JP)

(72) Inventors: Kousuke Shirai, Kosai (JP); Yuichiro Kawamura, Kosai (JP)

(73) Assignee: HAMANAKODENSO CO., LTD., Kosai (JP)

( * ) Notice: Subject to any disclaimer, the term of this patent is extended or adjusted under 35 U.S.C. 154(b) by 0 days.

(21) Appl. No.: 16/390,145

(22) Filed: Apr. 22, 2019

(65) Prior Publication Data

US 2019/0331063 A1 Oct. 31, 2019

(30) Foreign Application Priority Data

Apr. 26, 2018 (JP) ..... JP2018-085240
Feb. 6, 2019 (JP) ..... JP2019-019924

(51) Int. Cl.
*F02M 25/08* (2006.01)

(52) U.S. Cl.
CPC ..... *F02M 25/0836* (2013.01); *F02M 25/089* (2013.01); *F02M 2025/0845* (2013.01)

(58) Field of Classification Search
CPC ..... F02M 25/0836; F02M 25/089; F02M 2025/0845
See application file for complete search history.

(56) References Cited

U.S. PATENT DOCUMENTS

2018/0087475 A1* 3/2018 Mills ..... F02M 25/0872

FOREIGN PATENT DOCUMENTS

JP 2015-007455 A 1/2015

* cited by examiner

*Primary Examiner* — Xiao En Mo
(74) *Attorney, Agent, or Firm* — Harness, Dickey & Pierce, P.L.C.

(57) ABSTRACT

A control valve assembly includes a housing accommodating an electromagnetic coil unit which is disposed in an in-housing passage and drives a valve element to open and close the in-housing passage. An inflow-outflow member is coupled to the housing, and includes an inflow portion having an inflow passage through which evaporative fuel flows toward the in-housing passage, and an outflow portion having an outflow passage through which the evaporative fuel from the in-housing passage flows. The outflow passage in the outflow portion and the inflow passage in the inflow portion communicate with each other through the in-housing passage.

17 Claims, 20 Drawing Sheets

CONTROL VALVE ASSEMBLY

CROSS REFERENCE TO RELATED APPLICATIONS

The present application claims the benefit of priority from Japanese Patent Application No. 2018-085240 filed on Apr. 26, 2018, and Japanese Patent Application No. 2019-019924 filed on Feb. 6, 2019. The entire disclosure of the above applications is incorporated herein by reference.

TECHNICAL FIELD

The present disclosure relates to a control valve assembly.

BACKGROUND

A flow-control electromagnetic valve is disposed in an evaporative fuel passage extending from a fuel tank to an engine intake pipe through a canister.

SUMMARY

According to at least one embodiment of the present disclosure, a control valve assembly includes a housing and an inflow-outflow member. The housing accommodates an electromagnetic coil unit which is disposed in an in-housing passage and drives a valve element to open and close the in-housing passage. The inflow-outflow member is coupled to the housing. The inflow-outflow member includes an inflow portion having an inflow passage through which the evaporative fuel flows toward the in-housing passage, and an outflow portion having an outflow passage through which the evaporative fuel from the in-housing passage flows. The outflow passage in the outflow portion and the inflow passage in the inflow portion communicate with each other through the in-housing passage.

DETAILED DESCRIPTION

Figure 1:
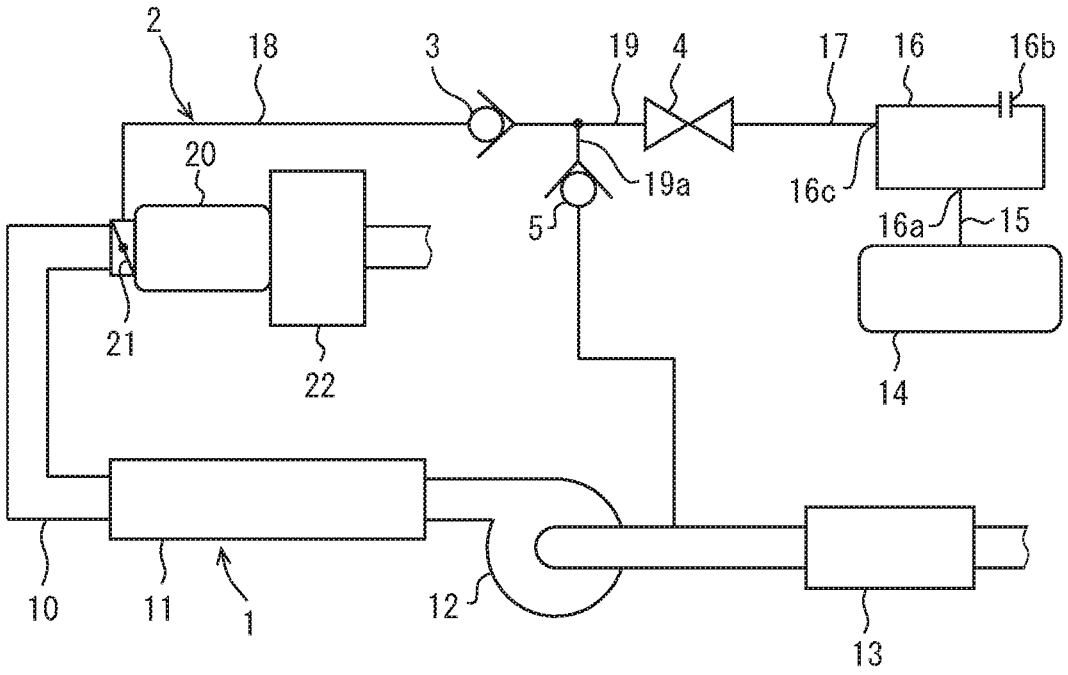
FIG. 1 is a schematic view showing an evaporative fuel processing system which can be equipped with a purge control valve according to at least one embodiment.
Figure 2:
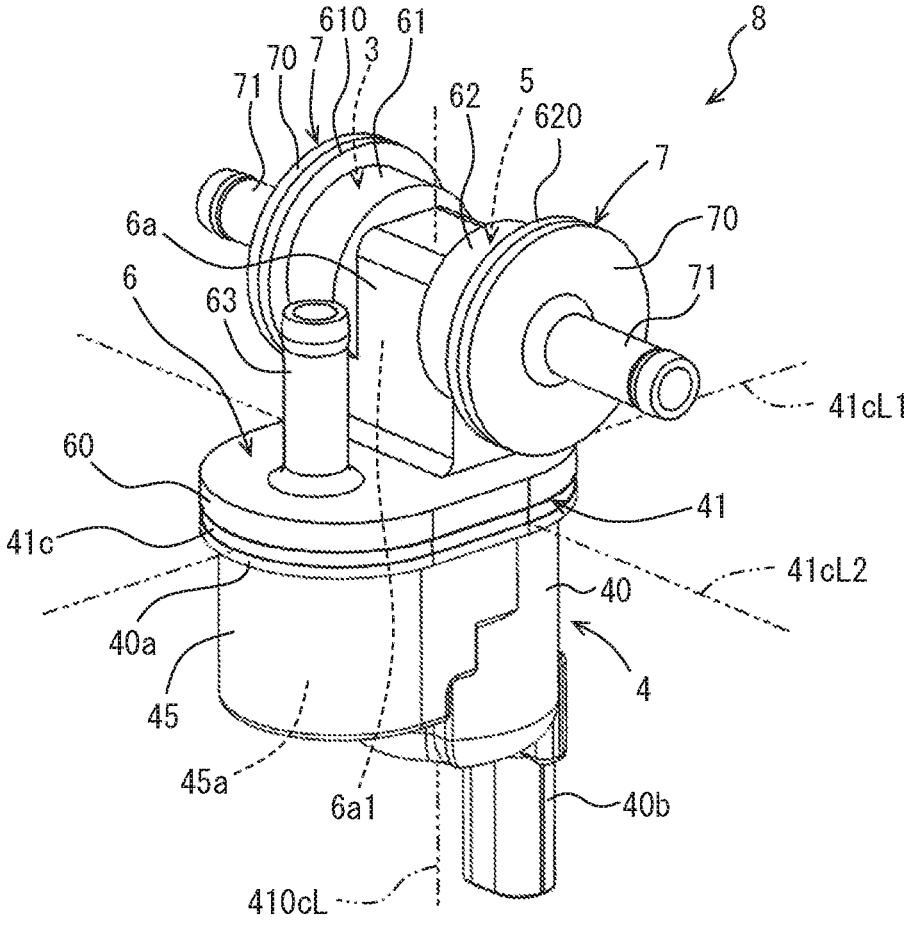
FIG. 2 is a perspective view showing a control valve assembly according to at least one embodiment.

Hereinafter, embodiments for implementing the present disclosure will be described referring to drawings. In each embodiment, portions corresponding to the elements described in the preceding embodiments are denoted by the same reference numerals, and redundant explanation may be omitted. In each of the embodiments, when only a part of the configuration is described, the other parts of the configuration can be applied to the other embodiments described above. It may be possible not only to combine parts the combination of which is explicitly described in an embodiment, but also to combine parts of respective embodiments the combination of which is not explicitly described if any obstacle does not especially occur in combining the parts of the respective embodiments.

First Embodiment

A first embodiment will be described with reference to FIGS. 1-5. An evaporative fuel processing system shown in FIG. 1 supplies HC gas and the like, which are contained in fuel adsorbed to a canister 16, to an intake passage of an engine 22. The evaporative fuel processing system prevents evaporative fuel generated in a fuel tank 14 from being released to the atmosphere. The evaporative fuel processing system includes a control valve assembly 8 that connects various components that form an evaporative fuel passage. The control valve assembly 8 has at least a purge control valve 4. The various components include functional components such as check valves, pipes that form passages, fittings, lids, and other passage wall members, disposed in the evaporated fuel passage. The control valve assembly 8 includes a housing 40 forming the purge control valve 4, an intermediate member 41 coupled to the housing 40, and an inflow-outflow member 6 coupled to the intermediate member 41. The housing 40, the intermediate member 41, and the inflow-outflow member 6 are each formed of resin.

Evaporative fuel introduced into an intake system 1 of the engine 22 is mixed with combustion fuel supplied from an injector or the like to the engine 22 and burned in a cylinder of the engine 22. In the intake system 1 of the engine 22, one end side of an intake pipe 10 is connected to an intake manifold 20 of the engine 22 through a throttle valve 21. A filter 13, a turbocharger 12, an intercooler 11 and the like are provided in the intake pipe 10. An evaporative fuel purge system 2 is formed by connecting the fuel tank 14 and the canister 16 to the intake manifold 20 through a pipe 15, a pipe 17, a relay pipe 19 and a pipe 18.

The filter 13 is provided at the most upstream portion of the intake pipe 10 and captures dust, dirt, etc. in intake air. The turbocharger 12 is constituted by an intake compressor for enhancing a charging efficiency of intake air. The turbocharger 12 is provided downstream of the filter 13 in an intake air flow between the intake manifold 20 and the filter 13. The turbocharger 12 includes a compressor that operates in conjunction with a turbine that is operated by the exhaust energy of the engine 22. The compressor of the turbocharger 12 pressurizes the intake air that has passed through the filter 13. The compressor supplies the intake air to the intake manifold 20.

The intercooler 11 is a heat exchanger for cooling. The intercooler 11 is provided downstream of the turbocharger 12. The intercooler 11 performs heat exchange between the intake air pressurized by the turbocharger 12 and outside air, and thereby cools the intake air. The throttle valve 21 is an intake amount adjustment valve that adjusts an amount of intake air flowing into the intake manifold 20 by adjusting an opening degree at an inlet of the intake manifold 20 in conjunction with an accelerator pedal. The intake air passes through the filter 13, the turbocharger 12, the intercooler 11 and the throttle valve 21 in sequence, flows into the intake manifold 20. Then, the intake air is mixed with the combustion fuel injected from the injector or the like at a predetermined air-fuel ratio to be burned in the cylinder.

The fuel tank 14 is a container for storing fuel such as gasoline. The fuel tank 14 is connected to an inflow portion 16*a* of the canister 16 through the pipe 15. The canister 16 is a container in which an adsorbent such as activated carbon is sealed. The canister 16 takes in evaporative fuel generated in the fuel tank 14 from the inflow portion 16*a* through the pipe 15 and temporarily adsorbs the evaporative fuel to the adsorbent. The canister 16 has a suction portion 16*b* for drawing fresh air from the outside. Since the canister 16 has the suction portion 16*b*, atmospheric pressure acts on the inside of the canister 16. The canister 16 can easily release the evaporative fuel adsorbed to the adsorbent by the fresh air drawn in.

A valve module, for example, is integrally provided in the suction portion 16*b*. The valve module includes therein a canister close valve that opens and closes the suction portion 16*b* through which external fresh air is drawn, and an internal pump capable of releasing gas to the atmosphere and suctioning atmosphere air. When the canister 16 includes the canister close valve, atmospheric pressure can be introduced in the canister 16. The canister 16 can easily release, i.e. purge, the evaporative fuel adsorbed to the adsorbent by the fresh air drawn in.

The canister 16 includes an outflow portion 16*c* through which the evaporative fuel released from the adsorbent flows out. One end side of the pipe 17 is connected to the outflow portion 16*c*. The other end of the pipe 17 is connected to an inflow portion of the purge control valve 4. The passage in the pipe 17 is also referred to as a fuel inflow passage through which the fuel flows into the purge control valve 4. The purge control valve 4 and a first check valve 3 are connected and communicate with each other through the relay pipe 19. An outflow side of the first check valve 3 is connected to one end side of the pipe 18. The passage in the pipe 18 is also referred to as a fuel outflow passage through which the fuel flowing out of the purge control valve 4 passes. The other end of the pipe 18 is connected to an inflow portion of the intake manifold 20.

Figure 3:
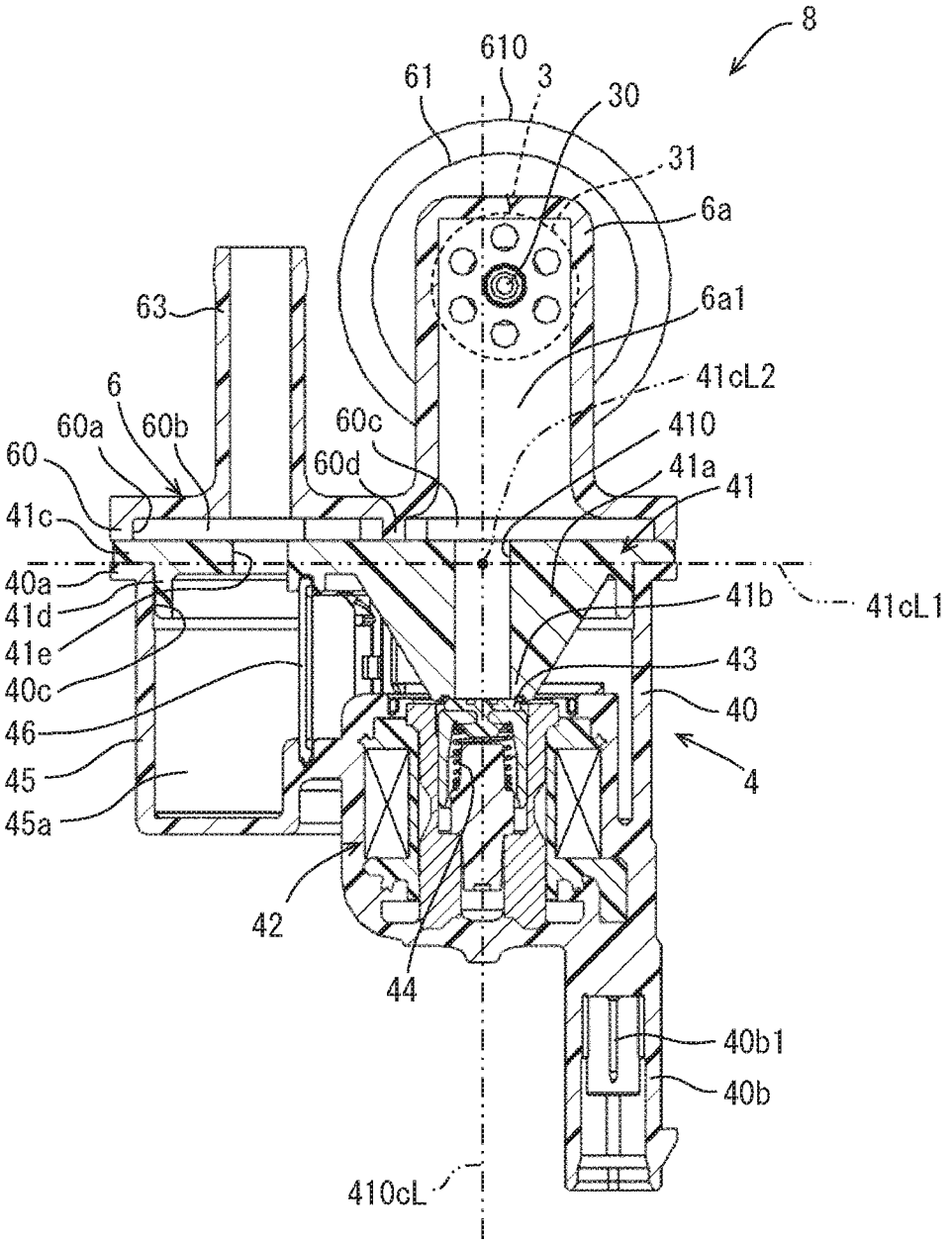
FIG. 3 is a cross-sectional view showing the control valve assembly according to at least one embodiment.

The purge control valve 4 is an opening and closing device for opening and closing the evaporative fuel passage, and can permit and block supply of the evaporative fuel from the canister 16 to the engine 22. As shown in FIG. 3, the purge control valve 4 includes a valve element 43 and an electromagnetic coil unit 42 including a coil and a spring 44. The purge control valve 4 opens and closes the evaporative fuel passage by driving the valve element 43 in accordance with balance between an electromagnetic force generated at the time of energization of the coil and an urging force of the spring 44.

The purge control valve 4 includes the housing 40 that forms an in-housing passage. The purge control valve 4 normally maintains a state in which the in-housing passage forming the evaporative fuel passage is closed. When the coil is energized, the electromagnetic force overcomes the elastic force of the spring 44, and the valve element 43 becomes away from a valve seat 41*b*. Thus, the purge control valve 4 provides a state in which the in-housing passage is open. A controller controls a ratio of a turned-on period to a period of one cycle consisted of the turned-on period and a turned-off period of the energization, that is, a duty ratio. The controller performs the energization of the coil at the controlled duty ratio. The purge control valve 4 is also referred to as a duty control valve. The amount of the evaporative fuel flowing through the in-housing passage is adjusted by this energization control performed by the controller.

The first check valve 3 is disposed in the evaporative fuel passage from the canister 16 to the intake pipe 10 between the purge control valve 4 and the intake manifold 20. The first check valve 3 allows a forward flow of the evaporative fuel from a fuel inflow passage (i.e. the passage in the relay pipe 19) to the fuel outflow passage (i.e. the passage in the pipe 18) in the evaporative fuel passage. The first check valve 3 prevents a reverse flow of the evaporative fuel from the fuel outflow passage to the fuel inflow passage. The first check valve 3 includes a valve element 30 that opens a flow path in accordance with the forward flow of the evaporative fuel and closes the flow path in accordance with the reverse flow of the evaporative fuel.

A branch passage formed inside a branch pipe 19*a* is a relay passage, i.e. a passage branched from a passage position between the purge control valve 4 and the first check valve 3. The first check valve 3 is a backflow prevention valve disposed between the branch point branched to the branch passage and the fuel outflow passage. The downstream end of the branch passage is connected to a pipe located upstream of the turbocharger 12 in intake air flow. Since the evaporative fuel processing system includes the branch pipe 19*a*, the evaporative fuel processing system can introduce the evaporative fuel, which has passed through the purge control valve 4, into the passage which is located upstream of the turbocharger 12 in intake air flow.

A second check valve 5 is a backflow prevention valve disposed in the branch passage. The second check valve 5 allows a forward flow of the evaporative fuel in the branch passage from the relay passage toward the passage which is located upstream of the turbocharger 12 in intake air flow. The second check valve 5 prevents a reverse flow of the evaporative fuel to the relay passage. The second check valve 5 includes a valve element 50 that opens a flow path in the branch passage, and closes the flow path in accordance with the reverse flow of the evaporative fuel.

When the turbocharger 12 is not operating during running of the vehicle (i.e. at the time of normal purge), opening of the purge control valve 4 by the controller causes a pressure gradient between a negative pressure in the intake manifold 20 generated by a suction action of the piston and the atmospheric pressure in the canister 16. This pressure gradient makes the vapor fuel adsorbed to the canister 16 to flow through the fuel inflow passage, the purge control valve 4, the relay passage, the first check valve 3 and the fuel outflow passage, and is sucked into the intake manifold 20.

Evaporative fuel sucked into the intake manifold 20 is mixed with original combustion fuel supplied from the injector or the like to the engine 22 and burned in the cylinder of the engine 22. Further, in the cylinder of the engine 22, the air-fuel ratio which is the mixing ratio of the combustion fuel and the intake air is controlled to be a predetermined air-fuel ratio set in advance. The controller adjusts a purge amount of the evaporative fuel by the duty-control of the open-closed periods of the purge control valve 4 such that the predetermined air-fuel ratio is maintained even if the evaporative fuel is purged.

When the turbocharger 12 is operating during running of the vehicle (i.e. at the time of turbocharge purge), the inside of the intake manifold 20 has a positive pressure due to the pressurized intake air. Therefore, the evaporative fuel cannot be supplied to the engine 22 through the purge control valve 4. Further, at the positive pressure, the evaporative fuel may flow back to be released into the atmosphere. The first check valve 3 is provided to prevent this backflow.

When the purge control valve 4 is opened at the time of turbocharge purge, the evaporative fuel adsorbed in the canister 16 flows through the fuel inflow passage, the purge control valve 4, the relay passage and the second check valve 5. Then, the evaporative fuel flows through the branch passage and is supplied to the passage which is located upstream of the turbocharger 12 in intake air flow. The evaporative fuel supplied to the upstream side of the turbocharger 12 reaches the inside of the intake manifold 20 through the intake pipe 10. Then, the evaporative fuel is mixed with original combustion fuel supplied from the injector or the like to the engine 22 and burned in the cylinder of the engine 22.

The housing 40 is a cup-shaped body having a bottom at one end and an opening 40*c* at another end opposite to the one end. The opening 40*c* has a shape like a running track, e.g, two opposite semicircles connected by two straight lines. The housing 40 accommodates the valve element 43 for opening and closing the in-housing passage, and an electromagnetic coil unit 42 for driving the valve element 43. The housing 40 has a housing chamber 45*a* on one side part of the bottom of the housing 40 while the electromagnetic coil unit 42 is disposed on another side part of the bottom opposite to the one side part. The housing 40 houses a filter 46 positioned in the in-housing passage and between the housing chamber 45*a* and the electromagnetic coil unit 42. The filter 46 is closer to the housing chamber 45*a* than the electromagnetic coil unit 42. The housing chamber 45*a* is a part of the in-housing passage defined between the filter 46 and the opening 40*c*. The housing chamber 45*a* is an internal space of a chamber forming portion 45. The chamber forming portion 45 is a part of the housing 40 which is opposite to another part of the housing 40 accommodating the electromagnetic coil unit 42.

The housing 40 is provided with a connector 40*b* attached to the part of the housing 40 in which the electromagnetic coil unit 42 is disposed. The connector 40*b* is a resin molded portion in which a terminal 40*b*1 for energizing the coil is incorporated, and the terminal 40*b*1 protrudes from the inside to the outside. The terminal 40*b*1 is a current-carrying terminal electrically connected to the coil. The connector 40*b* is connected to a power supply connector for power supply from a power source unit or a current control device. When the connector 40*b* and the power supply connector are connected and the terminal 40*b*1 is electrically connected to the current control device or the like, the purge control valve 4 can control a current supplied to the coil.

The housing 40 has a flange 40*a* that protrudes radially outward from the entire circumference of the opening 40*c*. The flange 40*a* is a portion joined to a flange 41*c* of the intermediate member 41 corresponding to an outer peripheral edge of the intermediate member 41. The intermediate member 41 is a member interposed between the housing 40 and the inflow-outflow member 6 and coupled to the housing 40 and the inflow-outflow member 6. The flange 40*a* is integrally joined with the flange 41*c* in a state of being overlapped with the flange 41*c*.

The flange 41 of the intermediate member 41 is an outer peripheral edge having an oval shape like a running track similar to the shape of the flange 40*a*. The intermediate member 41 includes an annular protrusion 41*d* and a cylindrical portion 41*a*, which protrude from a surface of the intermediate member 41 that faces the housing 40 in a thickness direction of the flange 41*c*.

Figure 4:
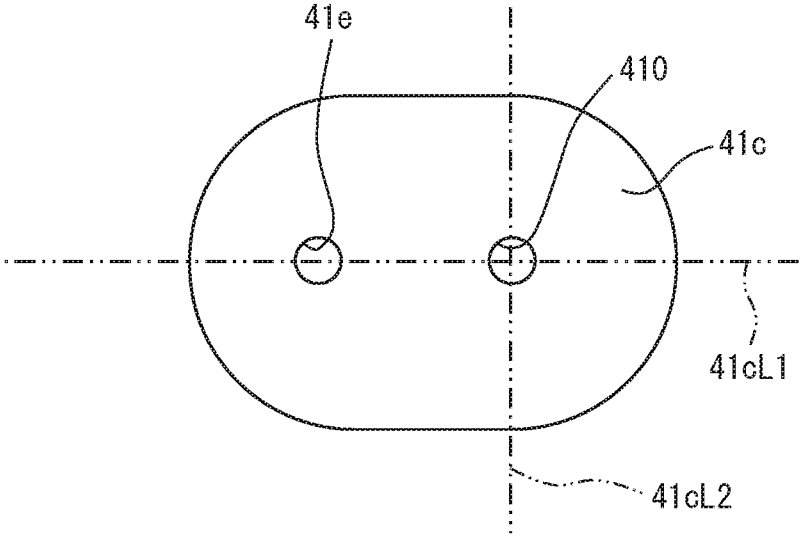
FIG. 4 is a view of an intermediate member in a passage axial direction.

The annular protrusion 41*d* is fitted with an inner peripheral wall surface of the opening 40*c* of the housing 40. As shown in FIGS. 3 and 4, a first passage 41*e* and a second passage 410 extend through the intermediate member 41 in the thickness direction and are provided apart from each other by a predetermined distance inside the annular protrusion 41*d*. The first passage 41*e* communicates with the second passage 410 via the housing chamber 45*a*. The tip end of the cylindrical portion 41*a* has the valve seat 41*b* that contacts the valve element 43. The cylindrical portion 41*a* has a shape protruding into the housing 40 and has the second passage 410 into which the evaporative fuel flows from the housing chamber 45*a* when the valve element 43 is open.

The inflow-outflow member 6 is connected to the housing 40 via the intermediate member 41. The inflow-outflow member 6 has an inflow portion 63 through which the evaporative fuel flows from the canister 16 into the inflow-outflow member 6, and an outflow portion 61 and an outflow portion 62 through which the evaporative fuel from the purge control valve 4 flows out of the inflow-outflow member 6 toward the engine 22. The inflow portion 63 has therein an inflow passage through which the evaporative fuel flows toward the in-housing passage of the housing 40. The inflow portion 63 is a tubular part that protrudes from the surface of the inflow-outflow member 6 opposite the intermediate member 41. The outflow portion 61 and the outflow portion 62 have an outflow passage branched into two passages on a downstream side of the purge control valve 4.

The inflow-outflow member 6 is provided with a flange 60 including an annular protrusion which protrudes in the thickness direction from the outer peripheral edge of the surface facing the intermediate member 41. The flange 60 is a portion joined to the flange 41*c* of the intermediate member 41. The flange 60 is integrally joined with the flange 41*c* in a state of being overlapped with the flange 41*c*.

Figure 5:
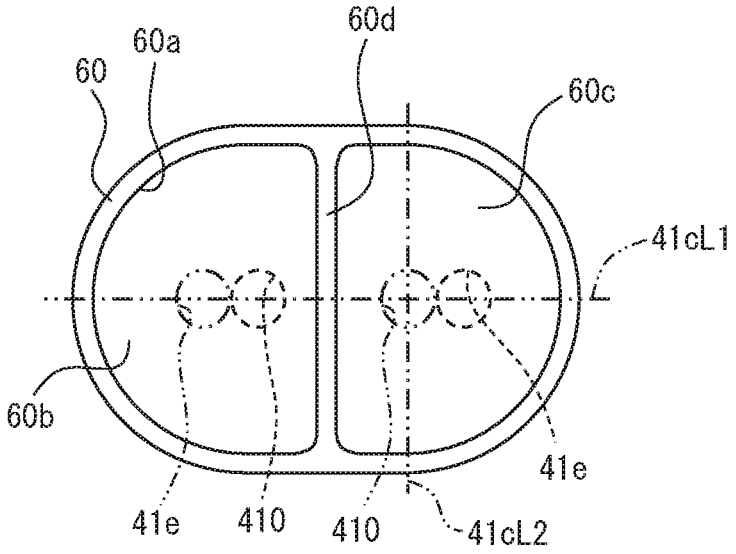
FIG. 5 is a view of an inflow-outflow member in the passage axial direction.

As shown in FIG. 5, the inflow-outflow member 6 includes a partition 60*d* that divides a first chamber 60*b* in which an outlet of the inflow passage opens and a second chamber 60*c* in which an inlet of the outflow passage opens. The first chamber 60*b* is a space having a flattened shape surrounded by the partition 60*d* and the annular projection of the flange 60. The second chamber 60*c* is a space having a flattened space surrounded by the partition 60*d* and the annular projection of the flange 60 on an opposite side of the partition 60*d* from the first chamber 60*b*. The partition 60*d* contacts an end face of the intermediate member 41 in a state where the flange 60 and the flange 41*c* are joined. The partition 60*d* defines the first chamber 60*b* and the second chamber 60*c*. Thus, the outflow passage in each of the outflow portion 61 and the outflow portion 62 and the inflow passage in the inflow portion 63 communicate with each other through the in-housing passage in the housing 40.

When the inflow-outflow member 6 is coupled to the intermediate member 41 as shown in FIG. 3, the outflow portion 61 and the outflow portion 62 are close to a passage axis 410*c*L of the second passage 410. In this case, the first passage 41*e* communicates with the first chamber 60*b* without communicating with the second chamber 60*c*, and the second passage 410 communicates with the second chamber 60*c* without communicating with the first chamber 60*b*. In this case, the first passage 41*e* and the second passage 410 are indicated by dash-two dotted circles in FIG. 5. When the orientation of the inflow-outflow member 6 shown in FIG. 3 is rotated by 180 degrees with respect to the intermediate member 41 and coupled to the intermediate member 41, the inflow portion 63 is close to the passage axis 410*c*L. In this case, the first passage 41*e* communicates with the second chamber 60*c* without communicating with the first chamber 60*b*, and the second passage 410 communicates with the first chamber 60*b* without communicating with the second chamber 60*c*. In this case, the first passage 41*e* and the second passage 410 are indicated by dash circles in FIG. 5. Imaginary lines 41*c*L1, 41*c*L2, which are dash-two dotted straight lines in FIGS. 2 to 5, are lines set on the end face of the flange 40*a* of the housing 40. According to such a configuration, the inflow-outflow member 6 can be connected to the housing 40 in the orientation inverted from the connection orientation of the inflow-outflow member 6 shown in FIG. 3. Therefore, it is possible to provide a control valve assembly which can be mounted on a system in which the evaporative fuel is reversed in the flow direction in the in-housing passage. Further, the control valve assembly 8 can absorb dimensional variations caused in manufacturing.

The imaginary line 41*c*L1 intersects both a passage axis of the first passage 41*e* and the passage axis 41*c*L of the second passage 410 as shown in FIG. 4. The imaginary line 41*c*L2 is perpendicular to both of the imaginary line 41*c*L1 and the passage axis 410*c*L. The passage axis 410*c*L is also a central axis of the electromagnetic coil unit 42. The inflow passage of the inflow portion 63 extends in a direction along the passage axis 410*c*L. When the valve element 43 is closed, air is present in the second chamber 60*c*. Thus, the second chamber 60*c* acts as an air layer and has thermal insulation performance.

Joining of the flanges, such as the flange 40*a*, the flange 41*c* and the flange 60, can be performed by melting the resin by laser irradiation and bonding them. The integral joining of the flanges may be formed by joining means using an adhesive. By integrally joining the flanges in this manner, the fluid flowing through the evaporative fuel passage in the control valve assembly 8 can be prevented from leaking to the outside.

The inflow-outflow member 6 includes an outflow housing 6*a* having an internal passage 6*a*1 through which the outflow portion 61 and the outflow portion 62 communicate with the second chamber 60*c*. The outflow portion 61 and the outflow portion 62 branched from the internal passage 6*a*1 are integrally provided in the outflow housing 6*a*. The outflow portion 61 and the outflow portion 62 are positioned to face each other across the internal passage 6*a*1. The outflow portion 61 and the outflow portion 62 each have partly the same shape to which various components can be attached. The same shape part may be attachable also to the component rotationally displaced about the axis of the same shape part. The same shape part may have, for example, a circular shape so that the component can be freely rotated and displaced around the axis of the circular shape. Alternatively, the same shape part may have a regular polygonal shape to which the component angularly displaced by a predetermined angle can be attached.

The outflow portion 61 has a flange 610 to which a component can be attached, and a cylindrical portion. The flange 610 is located on a distal end of the outflow portion 61, and is integrated with the cylindrical portion through which an opening inside the flange 610 communicates with the internal passage 6*a*1. The cylindrical portion is integrated with the outflow housing 6*a* on a proximal end of the outflow portion 61. The cylindrical portion integrally couples the outflow housing 6*a* and the flange 610.

The outflow portion 62 forms the outflow passage extending in a direction away from the outflow portion 61 in the inflow-outflow member 6. The passage axis of the outflow passage of the outflow portion 62 is along the outflow portion 61. The outflow portion 62 has a flange 620 to which a component can be attached, and a cylindrical portion. The flange 620 is located on a distal end of the outflow portion 62, and is integrated with the cylindrical portion through which an opening inside the flange 620 communicates with the internal passage 6*a*1. The cylindrical portion is integrated with the outflow housing 6*a* on a proximal end of the outflow portion 62. The cylindrical portion integrally couples the outflow housing 6*a* and the flange 620.

The inflow portion 63 is provided in the inflow-outflow member 6 such that the passage axis of the inflow portion 63 is oblique or orthogonal to the outflow portion 61 and the outflow portion 62. The outflow portion 61 and the outflow portion 62 have openings that open in different directions. The opening of the outflow portion 61 opens in the opposite direction to the opening of the outflow portion 62.

The valve element 30 having an umbrella shape and forming the first check valve 3 is disposed inside the cylindrical portion of the outflow portion 61. The outflow portion 61 includes a passage cross wall inside the cylindrical portion, and the passage cross wall divides the inside of the cylindrical portion into two parts in the fluid flow direction. The passage cross wall has a central hole penetrating the center of the passage cross wall, and a plurality of peripheral holes which are through holes penetrating the passage cross wall around the central hole. The passage cross wall supports the shaft of the valve element 30 in a state of being inserted into the central hole. The plurality of peripheral holes are passages through which the internal passage 6*a*1 in the outflow housing 6*a* communicates with the outflow passage in the outflow portion 61.

The valve element 50 having an umbrella shape and forming the second check valve 5 is disposed inside the cylindrical portion of the outflow portion 62. The outflow portion 62 includes a passage cross wall inside the cylindrical portion, and the passage cross wall divides the inside of the cylindrical portion into two parts in the fluid flow direction. The passage cross wall has a central hole and a plurality of peripheral holes similar to the outflow portion 61. The passage cross wall supports the shaft of the valve element 50 in a state of being inserted into the central hole.

The first check valve 3 and the second check valve 5 are positioned to face each other across the internal passage 6*a*1.

The valve element of each check valve has the shaft supported by the passage cross wall and an umbrella part integrated with the base side part of the shaft. The umbrella part is elastically deformable, and covers the peripheral holes in the outflow passage of each of the outflow portions 61 and 62. The umbrella part is in contact with a part of the passage cross wall positioned radially outward of the peripheral holes. When a pressure toward the internal passage 6*a*1 acts on the umbrella part, the umbrella part adheres to the passage cross wall. Accordingly, each check valve prevents a reverse flow of the evaporative fuel from the outflow passage to the internal passage 6*a*1. When a pressure from the internal passage 6*a*1 acts on the umbrella part, the umbrella part elastically deforms and separates from the passage cross wall. Accordingly, each check valve allows a flow of the evaporative fuel from the internal passage 6*a*1 through the peripheral holes to the outflow passage.

Since the inflow-outflow member 6 includes the check valves, the control valve assembly 8 can be equipped with the check valves. Further, since the control valve assembly 8 accommodates the check valves, the control valve assembly 8 contributes to reducing the size of the entire assembly, and effectively utilizes an installation space.

A tubular member 7 which is one of components is attached to each of the outflow portions 61, 62. The tubular member 7 includes a flange 70 fixed to the outflow portions 61, 62 by welding or adhesion, and a tubular portion 71 extending from the flange 70. The tubular portion 71 has therein a passage communicating with the internal space of the outflow portion. The tubular portion 71 is connected to a pipe forming an evaporative fuel passage in the evaporative fuel processing system. Thus, the control valve assembly 8 includes the housing 40 accommodating the electromagnetic coil unit 42, the intermediate member 41, the inflow-outflow member 6, and the two tubular members 7 connected to the inflow-outflow member 6, and a first check valve 3 and a second check valve 5 accommodated in the inflow-outflow member 6.

The tubular member 7 coupled to the outflow portion 61 is connected to the pipe 18. The tubular member 7 is connected the throttle valve 21 through the pipe 18. The tubular member 7 connected to the outflow portion 62 is connected to the branch pipe 19*a*. The tubular member 7 is connected through the branch pipe 19*a* to the passage which is positioned upstream of the turbocharger 12 in intake air flow.

Next, the effects provided by the control valve assembly 8 of the first embodiment will be described. The control valve assembly 8 is disposed in the evaporative fuel passage through which the evaporative fuel desorbed from the canister 16 flows toward the engine 22. The control valve assembly 8 includes the housing 40 accommodating the electromagnetic coil unit 42 that drives the valve element 43 for opening and closing the in-housing passage. The control valve assembly 8 includes the inflow-outflow member 6 connected to the housing 40. The inflow-outflow member 6 includes the inflow portion 63 that defines therein the inflow passage through which the evaporative fuel flows toward the in-housing passage. The inflow-outflow member 6 includes the outflow portions 61, 62 that define therein the outflow passages through which the evaporated fuel flowing out of the in-housing passage passes. The outflow passage in the outflow portion 61 and the inflow passage in the inflow portion 63 communicate with each other through the in-housing passage.

The control valve assembly 8 has a configuration connecting the housing 40 and the inflow-outflow member 6. The housing 40 accommodates the electromagnetic coil unit 42 that drives the valve element 43, while the inflow-outflow member 6 is separate from the housing 40 and includes the inflow portion 63 and the outflow portion 61 for the evaporative fuel. According to this configuration, just changing the orientations and the like of the inflow portion 63 and the outflow portion 61 of the inflow-outflow member 6 can newly provide the control valve assembly 8 that meets different specifications and the like of the vehicle. As a result, various components can be installed at various positions and orientations according to the positions and orientations of the inflow portion 63 and the outflow portion 61. According to this control valve assembly 8, the direction and the like of the passage connected to the control valve in the evaporated fuel passage can be widely selected. Such components include the check valve, the tubular member 7 and a lid 9.

According to such control valve assembly 8, it is possible to realize installation of various components at positions where influence of vibrations can be reduced as much as possible in an area where vibratory components such as the engine 22 exist. Further, the control valve assembly 8 is applicable to an evaporative fuel processing system capable of being used for various vehicle product specifications, and can contribute to reducing the number of component management steps involved in component connection in the evaporative fuel processing system.

The components included in the control valve assembly 8 are various components provided in the evaporative fuel processing system. The control valve assembly 8 is an assembly in which a plurality of components are connected to the purge control valve 4. The control valve assembly 8 constitutes a specific portion of the evaporative fuel passage. The plurality of components are connected through the housing 40 that houses the electromagnetic coil unit 42. Thus, the number of parts to be connected, the direction in which each of multiple passages extends, and the positional relationship and directional relationship regarding the multiple passages are selectable.

The control valve assembly 8 contributes to efficiently and rationally installing various components, pipes, and the like in a narrow space such as an engine compartment, and setting their installation conditions as desired.

The intermediate member 41 includes the valve seat 41*b* on which the valve element 43 is seated, the first passage 41*e* communicating with the inflow passage, and the second passage 410 communicating with the outflow passage. The intermediate member 41 is interposed between the housing 40 and the inflow-outflow member 6 and couples the housing 40 and the inflow-outflow member 6. According to this configuration of the intermediate member 41, the housing 40 accommodating the electromagnetic coil unit 42 is separated from the valve seat 41*b* as separate components. Thus, the housing 40 can be miniaturized, and the configuration as a common component can be simplified.

The inflow-outflow member 6 is provided with the first chamber 60*b* and the second chamber 60*c* on different sides of the partition 60*d*. The outlet of the inflow passage is open to the first chamber 60*b*, and the inlet of the outflow passage is open to the second chamber 60*c*. According to this, the inflow passage and the outflow passage, which communicate with each other through the in-housing passage, can be provided on the same side of the housing 40 in the evaporative fuel passage. As a result, operability of piping and the like extending from the control valve assembly 8 can be improved.

The control valve assembly 8 includes the tubular members 7 separated from the inflow-outflow member 6 and attached to the outflow portions 61, 62. According to this configuration, the tubular members 7 suitable for the shape and size of piping constituting the system can be attached to the inflow-outflow member 6. Thus, piping which is not limited to the shape of the inflow portion or outflow portion can be coupled to the control valve assembly 8.

The inflow-outflow member 6 has the first outflow portion 61 and the second outflow portion 62 as outflow portions. The control valve assembly 8 further includes the first check valve 3 disposed inside the first outflow portion 61, and the second check valve 5 disposed inside the second outflow portion 62. According to this configuration, the control valve assembly 8 can be mounted on the evaporative fuel processing system of the first embodiment. The control valve assembly 8 can further provide a passage where the evaporative fuel branches into two flows on the upstream side of the check valve in the passage from the purge control valve 4 toward the intake manifold 20. According to the control valve assembly 8 forming the branched path in this manner, piping can be installed so as to avoid surrounding parts. Thus, vibration transmission from the surrounding parts can be reduced, and effective use of the installation space can be achieved.

The outflow portion 61, the outflow portion 62 and the inflow portion 63 have openings that open in different directions. According to this, the components connected to the purge control valve 4 can be arranged to extend in different directions from the other components. Thus, the installation space of the control valve assembly 8 can effectively utilized.

In the inflow-outflow member 6, the first outflow portion 61 and the second outflow portion 62 face and are opposed to each other in an opposed relationship. The inflow portion 63 extends in a direction intersecting with the opposing direction in which the first outflow portion 61 and the second outflow portion 62 face. According to this, the control valve assembly 8 is applicable to a system having a passage branching the evaporative fuel passing through the internal passage **6*a*1 in the outflow housing 6*a*** into the opposite flows.

Second Embodiment

A second embodiment will be described with reference to FIG. 6. In the following description, explanations for configurations, operations and effects of the second embodiment that are the same as those of the first embodiment will be omitted. That is, features of the second embodiment different from those of the first embodiment will be described hereafter.

An inflow-outflow member 106 of the second embodiment is different from the inflow-outflow member 6 of the first embodiment. Therefore, in the second embodiment, a configuration regarding a control valve assembly 108 is different from that of the first embodiment.

Figure 6:
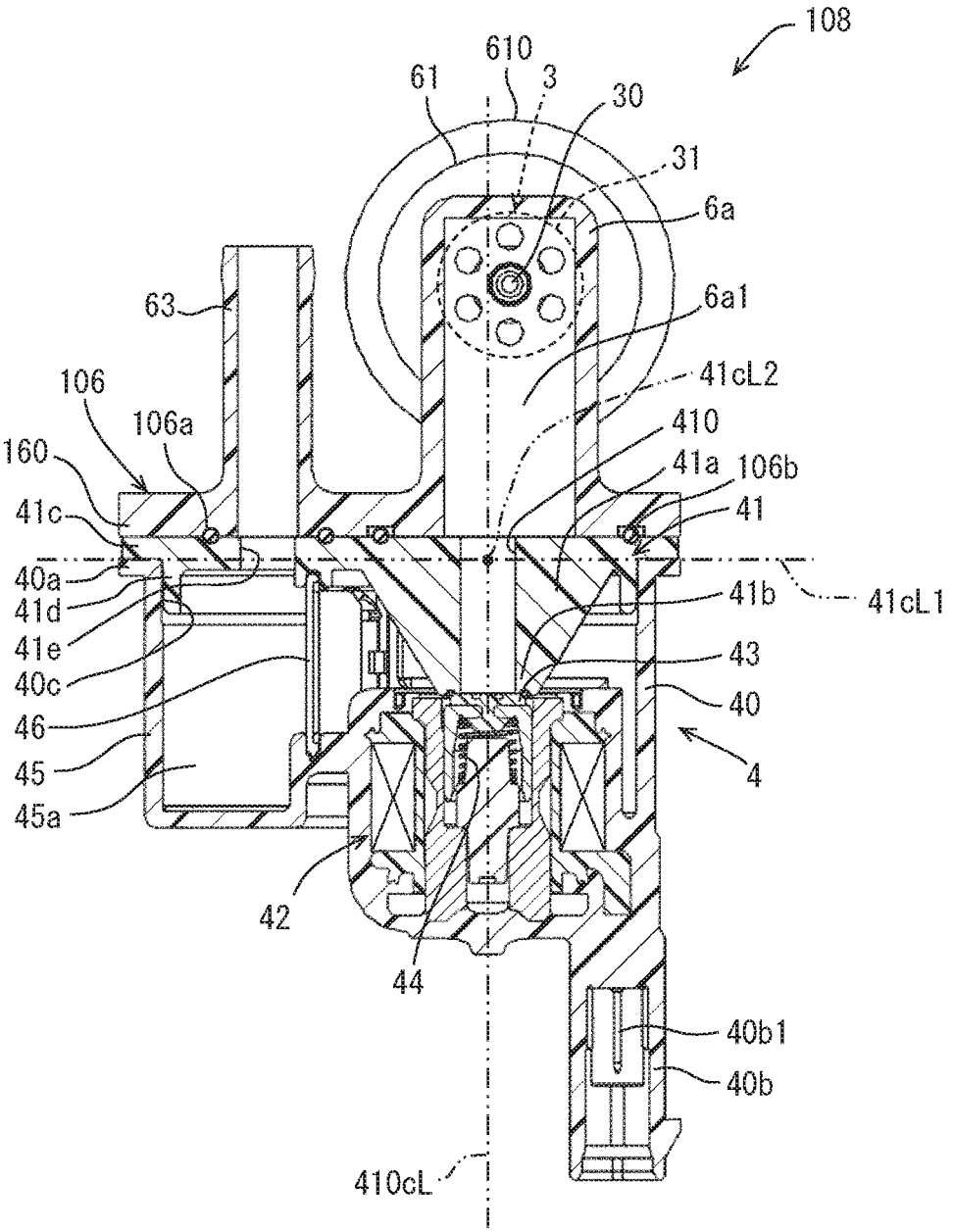
FIG. 6 is a cross-sectional view showing a control valve assembly according to at least one embodiment.

As shown in FIG. 6, the inflow-outflow member 106 of the control valve assembly 108 includes a flange 160 which is different in structure from the flange 60 of the inflow-outflow member 6. A surface of the flange 160 facing an intermediate member 41 is flat as a whole. That is, the first chamber **60*b* and the second chamber 60*c* are not formed in the inflow-outflow member 106. Thus, also in the inflow-outflow member 106, an outflow passage in each of an outflow portion 61 and an outflow portion 62 and an inflow passage in an inflow portion 63** communicate with each other through an in-housing passage.

The inflow-outflow member 106 has a first seal portion **106*a* and a second seal portion 106*b* on an inner side of the flange 160. The first seal portion 106*a* is an O-ring member that hermetically seals between the intermediate member 41 and the inflow-outflow member 106 around the first passage 41*e* of the intermediate member 41. The second seal portion 106*b* is an O-ring member that hermetically seals between the intermediate member 41 and the inflow-outflow member 106 around the second passage 410 of the intermediate member 41. The flange 160 is a portion joined to the flange 41*c* of the intermediate member 41. The flange 160 is integrally joined with the flange 41*c* in a state of being overlapped with the flange 41*c***.

Third Embodiment

Figure 7:
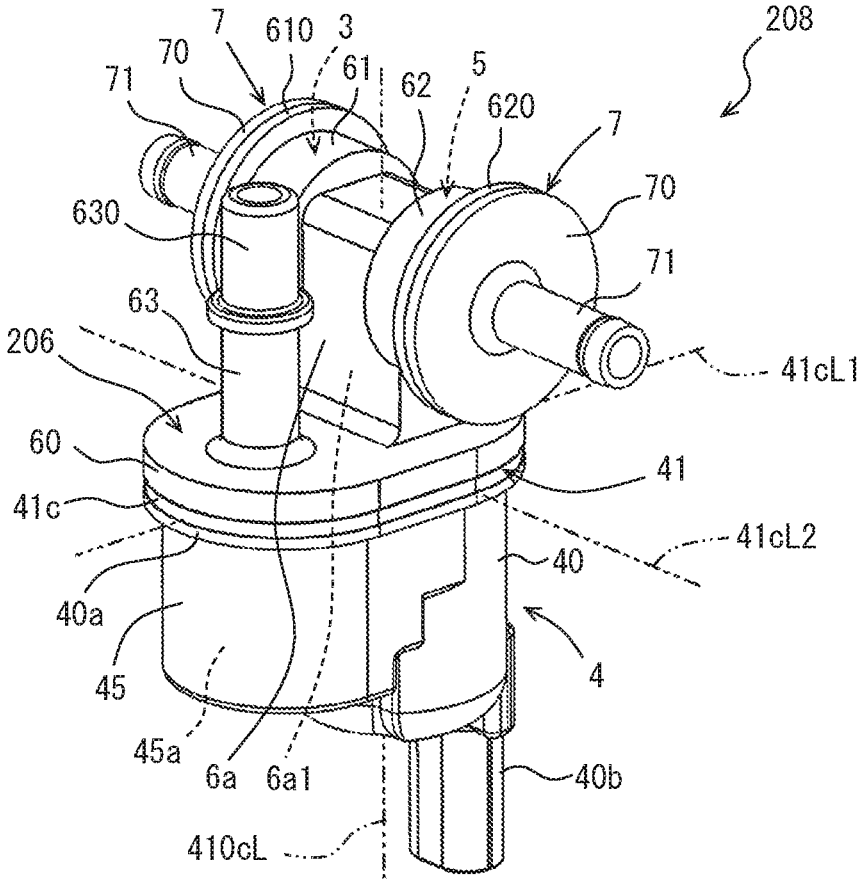
FIG. 7 is a perspective view showing a control valve assembly according to at least one embodiment.

A third embodiment will be described with reference to FIG. 7. In the following description, explanations for configurations, operations and effects of the third embodiment that are the same as those of the first embodiment will be omitted. That is, features of the third embodiment different from those of the first embodiment will be described hereafter.

A control valve assembly 208 of the third embodiment is different from the control valve assembly 8 of the first embodiment. The control valve assembly 208, as shown in FIG. 7, includes a tubular member 630 coupled to an inflow portion 63 of an inflow-outflow member 206. The tubular member 630 is connected to a pipe 17. The tubular member 630 is connected the canister 16 through the pipe 17.

Fourth Embodiment

A fourth embodiment will be described with reference to FIG. 8. In the following description, explanations for configurations, operations and effects of the fourth embodiment that are the same as those of the first embodiment will be omitted. That is, features of the fourth embodiment different from those of the first embodiment will be described hereafter.

An inflow-outflow member 306 of the fourth embodiment is different from the inflow-outflow member 6 of the first embodiment. Therefore, in the fourth embodiment, a configuration regarding a control valve assembly 308 is different from that of the first embodiment.

Figure 8:
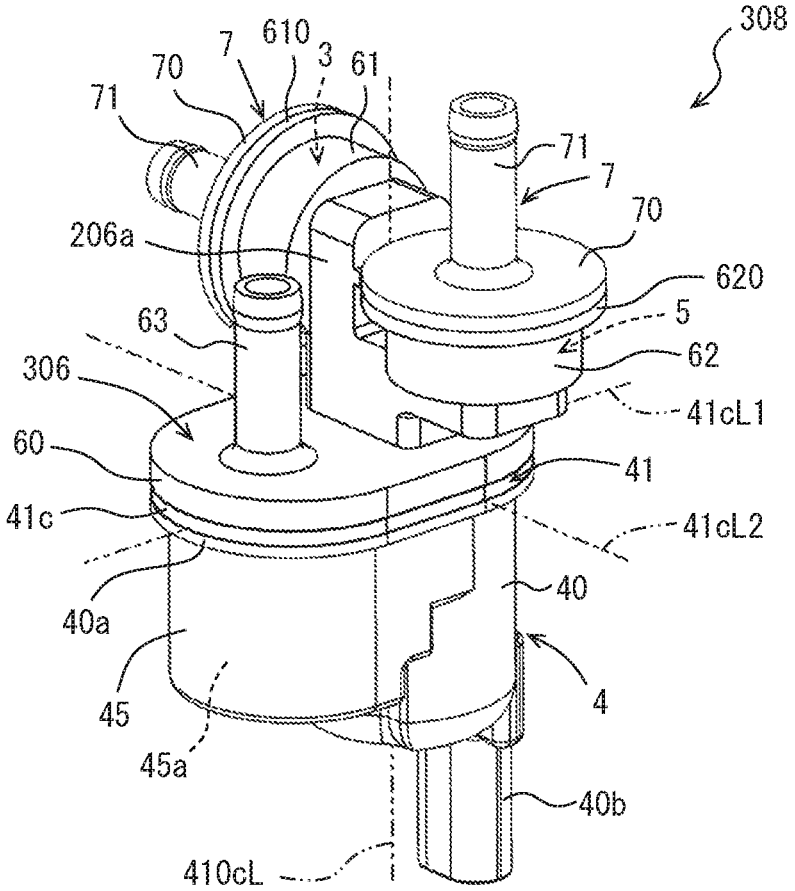
FIG. 8 is a perspective view showing a control valve assembly according to at least one embodiment.

As shown in FIG. 8, the inflow-outflow member 306 of the control valve assembly 308 includes an outflow housing **206*a* having an internal passage 6*a*1 through which the outflow portion 61 and the outflow portion 62 communicate with the second chamber 60*c*. The outflow portion 61 and the outflow portion 62 branched from the internal passage 6*a*1 are integrally provided in the outflow housing 206*a*. The outflow portion 61 and the outflow portion 62 have outflow passages extending in directions intersecting with each other. A passage axis of the outflow portion 62 is along the inflow portion 63**.

According to the fourth embodiment, the inflow-outflow member 306 has the first outflow portion 61 and the second outflow portion 62 as outflow portions. The first outflow portion 61 and the second outflow portion 62 extend in directions intersecting with each other in a crossed relation. The inflow portion 63 extends along either the first outflow portion 61 or the second outflow portion 62. According to this, the control valve assembly 308 is applicable to a system having a passage dividing the evaporative fuel passing through the internal passage 6*a*1 in the outflow housing 206*a* into a straight flow and a branched flow.

Fifth Embodiment

Figure 9:
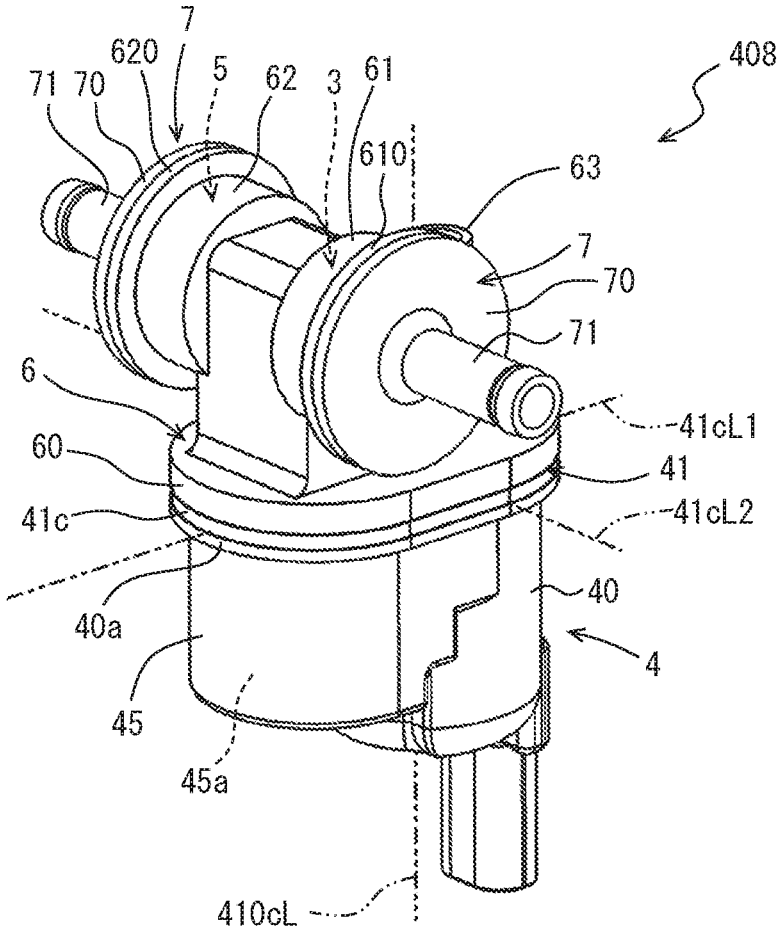
FIG. 9 is a perspective view showing a control valve assembly according to at least one embodiment.
Figure 10:
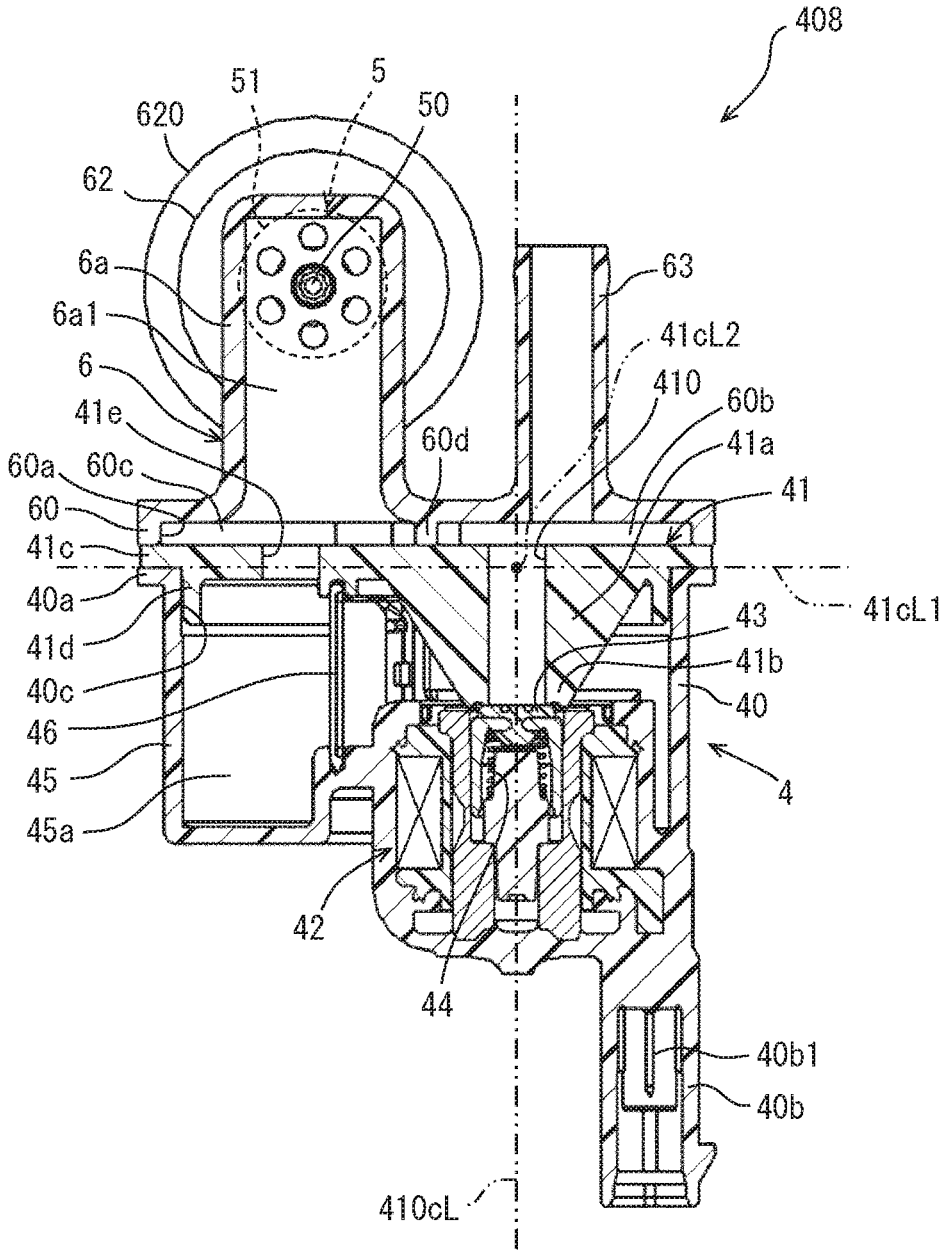
FIG. 10 is a cross-sectional view showing a control valve assembly according to at least one embodiment.

A fifth embodiment will be described with reference to FIGS. 9 and 10. In the following description, explanations for configurations, operations and effects of the fifth embodiment that are the same as those of the first embodiment will be omitted. That is, features of the fifth embodiment different from those of the first embodiment will be described hereafter.

The fifth embodiment is different from the first embodiment in the circumferential position of the inflow-outflow member 6 with respect to the central axis of the housing 40 or the connection position of the inflow-outflow member 6 with respect to the central axis of the housing 40. In a control valve assembly 408 of the fifth embodiment, as shown in FIGS. 9 and 10, the inflow-outflow member 6 is connected to the housing 40 such that the inflow portion 63 faces the second passage 410 and the internal passage 6*a*1 faces the first passage 41*e*. That is, the control valve assembly 408 is connected to the intermediate member 41 at an orientation where the inflow-outflow member 6 is rotated 180 degrees about the central axis from the orientation of the inflow-outflow member 6 of the control valve assembly 8.

According to the positional relationship between the inflow-outflow member 6 and the housing 40, the first passage 41*e* communicates with the internal passage 6*a*1, and the second passage 410 communicates with the inflow passage of the inflow portion 63. According to the control valve assembly 408, in the open state, the evaporative fuel passes from the inflow portion 63 to the first chamber 60*b*, the second passage 410, the filter 46, the housing chamber 45*a*, the first passage 41*e*, the second chamber 60*c* and then the outflow portions 61 and 62 in this order.

According to the fifth embodiment, the partition 60*d* is provided in the inflow-outflow member 6 such that both a first connection state and a second connection state can be achieved depending on the connection position of the inflow-outflow member 6 about the central axis of the housing 40. The first connection state is a state where the outlet of the inflow passage is connected to one end of the in-housing passage, and the inlet of the outflow passage is connected to another end of the in-housing passage. The second connection state is a state where the outlet of the inflow passage is connected to the other end of the in-housing passage, and the inlet of the outflow passage is connected to the one end of the in-housing passage. According to this, the control valve assembly 408 can be mounted on a system in which the flow direction of the evaporative fuel in the in-housing passage of the housing 40 is reversed.

Sixth Embodiment

Figure 11:
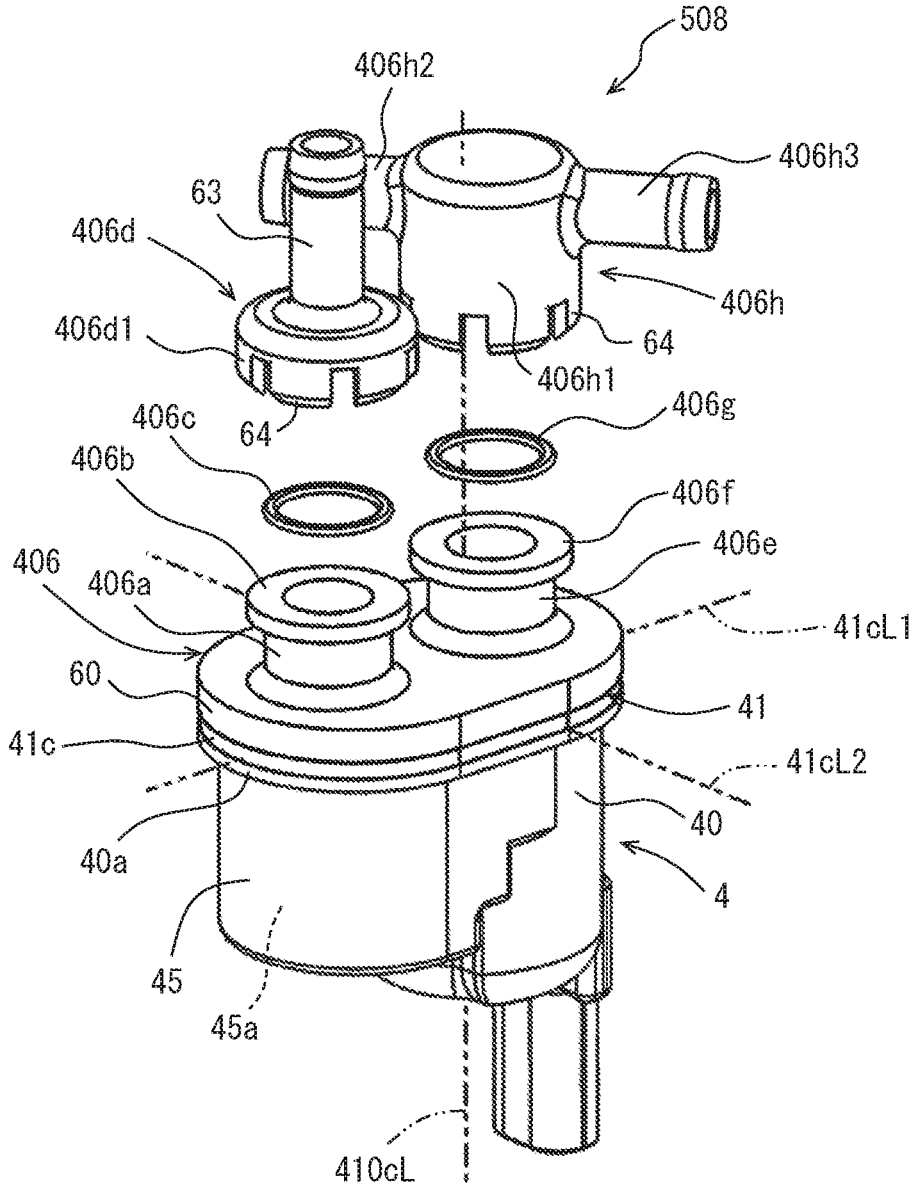
FIG. 11 is an exploded view showing a control valve assembly according to at least one embodiment.
Figure 12:
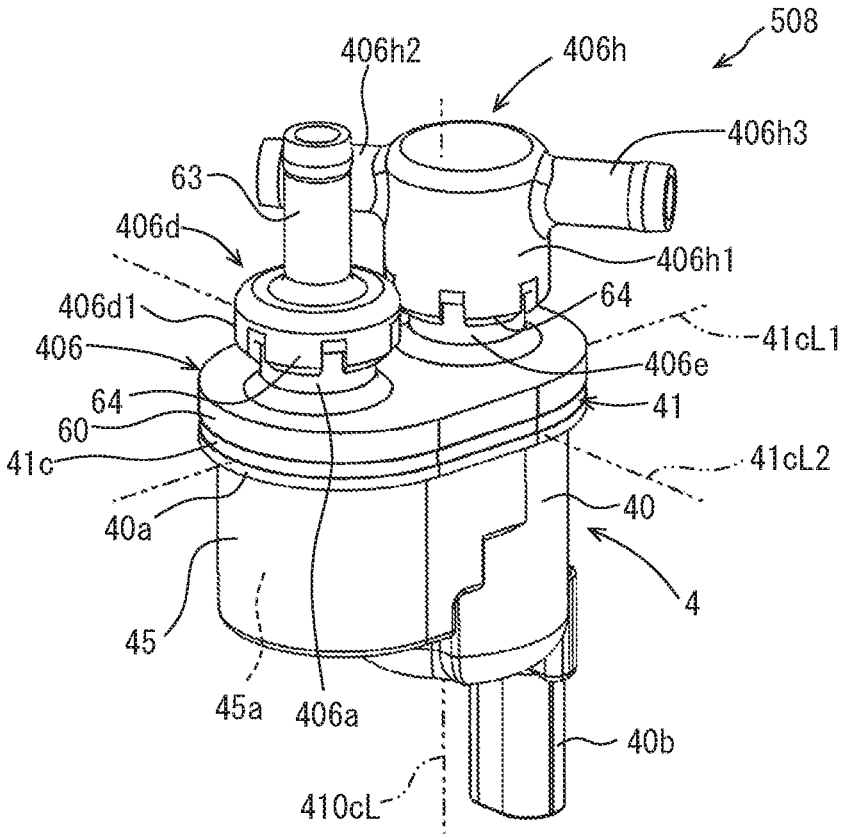
FIG. 12 is a perspective view showing a control valve assembly according to at least one embodiment.

A sixth embodiment will be described with reference to FIGS. 11 and 12. In the following description, explanations for configurations, operations and effects of the sixth embodiment that are the same as those of the first embodiment will be omitted. That is, features of the sixth embodiment different from those of the first embodiment will be described hereafter.

A control valve assembly 508 of the sixth embodiment is different from the control valve assembly 8 of the first embodiment. As shown in FIGS. 11 and 12, the control valve assembly 508 includes a canister-side coupler 406*d* and an engine-side coupler 406*h* which can be attached to and removed from the inflow-outflow member 406.

The canister-side coupler 406*d* includes an inflow portion 63 which is a tubular portion, a cylindrical portion 406*d*1 integrated with the tubular portion, and multiple engaging portions 64 provided on the cylindrical portion 406*d*1. For example, the end sides of the engaging portions 64 are free ends, and the multiple engaging portions 64 are provided over the entire circumference of the cylindrical portion 406*d*1. The engaging portions 64 are engaged with an end flange 406*b* of a first cylindrical portion 406*a* in a state of being externally fitted to the end flange 406*b*. When the canister-side coupler 406*d* is fixed to the first cylindrical portion 406*a*, the engaging portions 64 first deform to expand radially outward and then return radially inward by a restoring force. Accordingly, the engaging portions 64 are supported so as to hold the outer periphery of the end flange 406*b*. According to this configuration, the engaging portions 64 are attachable to and detachable from the first cylindrical portion 406*a*. The first cylindrical portion 406*a* constitutes an inflow portion having therein an inflow passage through which the evaporative fuel flows toward the in-housing passage. An O-ring member 406*c* is airtightly sandwiched between the canister-side coupler 406*d* and the end flange 406*b*, and the inflow passage is shut off from the outside.

The engine-side coupler 406*h* includes a tubular portion 406*h*2 and a tubular portion 406*h*3 facing each other in an opposed relationship, a tubular portion 406*h*1 integrated with these tubular portions 406*h*2, 406*h*3, and multiple engaging portions 64 provided in the tubular portion 406*h*1. For example, the end sides of the engaging portions 64 are free ends, and the multiple engaging portions 64 are provided over the entire circumference of the cylindrical portion 406*h*1. The engaging portions 64 are engaged with an end flange 406*f* of a second cylindrical portion 406*e* in a state of being externally fitted to the end flange 406*f*. When the engine-side coupler 406*h* is fixed to the second cylindrical portion 406*e*, the engaging portions 64 first deform to expand radially outward and then return radially inward by a restoring force. Accordingly, the engaging portions 64 are supported so as to hold the outer periphery of the end flange 406*f*. According to this configuration, the engaging portions 64 are attachable to and detachable from the second cylindrical portion 406*e*. An O-ring member 406*g* is airtightly sandwiched between the engine-side coupler 406*h* and the end flange 406*f*, and the inflow passage is shut off from the outside.

According to the sixth embodiment, the canister-side coupler 406*d* and the engine-side coupler 406*h* are coupled to the inflow-outflow member 406. The canister-side coupler 406*d* and the engine-side coupler 406*h* are separate from each other and capable of being connected to pipes. Each coupler 406*d*, 406*h* includes the engaging portions 64 which are attachable to and detachable from the inflow-outflow member 406. According to this configuration, the canister-side coupler 406*d* and the engine-side coupler 406*h* are attachable to and detachable from the inflow-outflow member 406. Thus, the canister-side coupler 406*d* and the engine-side coupler 406*h* can be exchanged with each other and can be connected to the inflow-outflow member 406. Accordingly, the control valve assembly 508 can be mounted on a system in which the flow direction of the evaporative fuel in the in-housing passage of the housing 40 is reversed.

The engine-side coupler 406*h* includes two tubular portions 406*h*2 and 406*h*3 to which pipes can be connected. The two tubular portions 406*h*2, 406*h*3 are provided at positions facing each other in the engine-side coupler 406*h*. According to this configuration, the control valve assembly 508 is applicable to a system having a passage that divides the evaporated fuel flowing out of the purge control valve 4 into branched flows in opposite directions.

Seventh Embodiment

Figure 13:
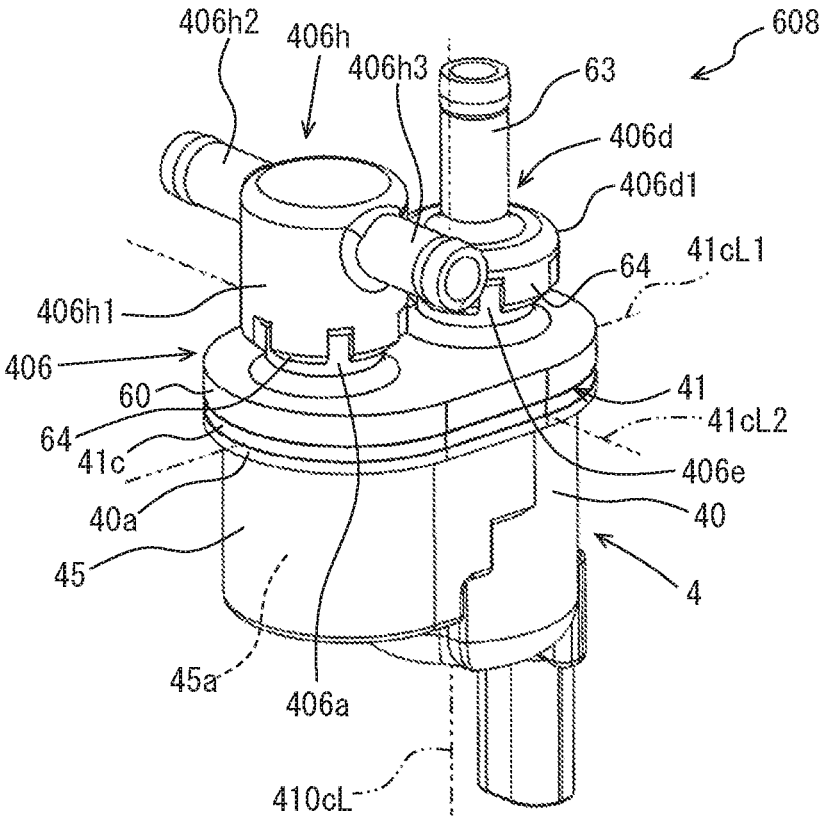
FIG. 13 is a perspective view showing a control valve assembly according to at least one embodiment.

A seventh embodiment will be described with reference to FIG. 13. In the following description, explanations for configurations, operations and effects of the seventh embodiment that are the same as those of the sixth embodiment will be omitted. That is, features of the seventh embodiment different from those of the sixth embodiment will be described hereafter. As shown in FIG. 13, in the control valve assembly 608 of the seventh embodiment, an engine-side coupler 406*h* and a first cylindrical portion 406*a* are connected, and a canister-side coupler 406*d* and a second cylindrical portion 406*e* are connected.

Eighth Embodiment

An eighth embodiment will be described with reference to FIG. 14. In the following description, explanations for configurations, operations and effects of the eighth embodiment that are the same as those of the sixth embodiment will be omitted. That is, features of the eighth embodiment different from those of the sixth embodiment will be described hereafter.

An engine-side coupler 406*i* of the eighth embodiment is different from the engine-side coupler 406*h* of the sixth embodiment. Therefore, in the eighth embodiment, a configuration regarding a control valve assembly 708 is different from that of the first embodiment.

Figure 14:
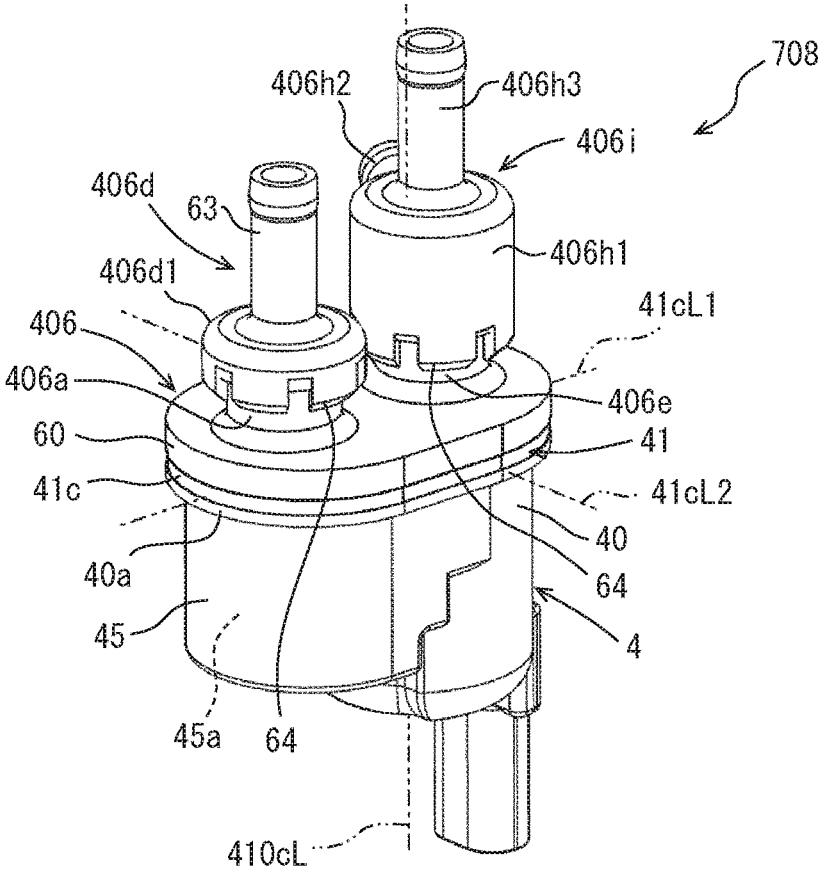
FIG. 14 is a perspective view showing a control valve assembly according to at least one embodiment.

As shown in FIG. 14, the engine-side coupler 406*i* has outflow passages extending in directions in which the tubular portion 406*h*2 and the tubular portion 406*h*3 cross each other. A passage axis of the tubular portion 406*h*3 is along an inflow portion 63. According to this, the control valve assembly 708 is applicable to a system having a passage dividing evaporative fuel passing through an outflow passage in a second cylindrical portion 406*e* into a straight flow and a branched flow.

Ninth Embodiment

Figure 15:
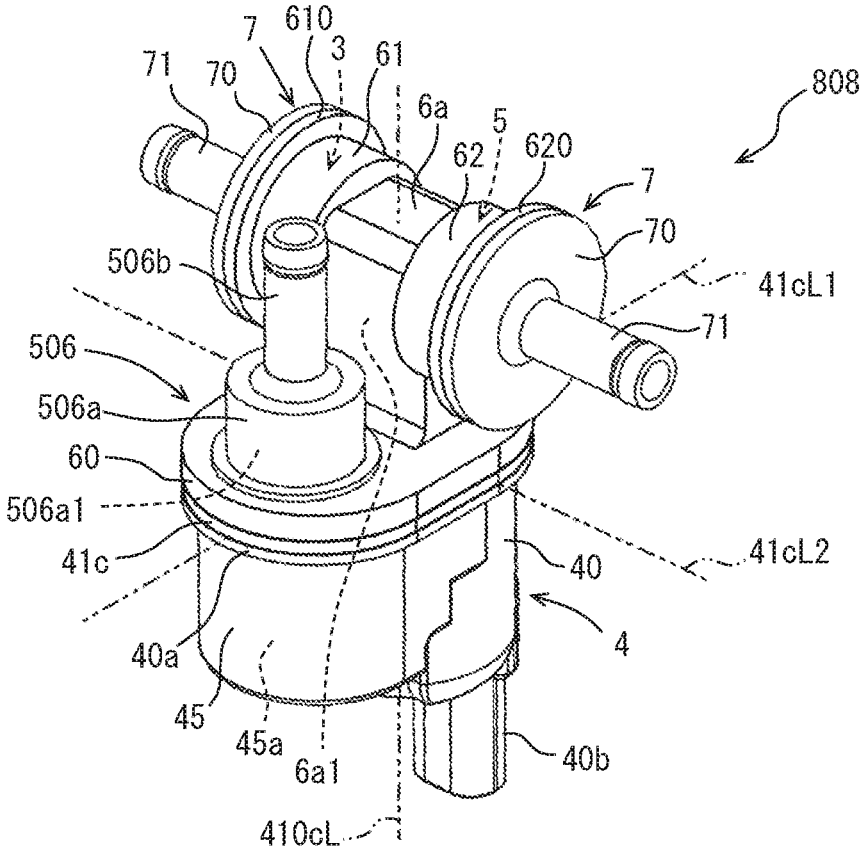
FIG. 15 is a perspective view showing a control valve assembly according to at least one embodiment.
Figure 16:
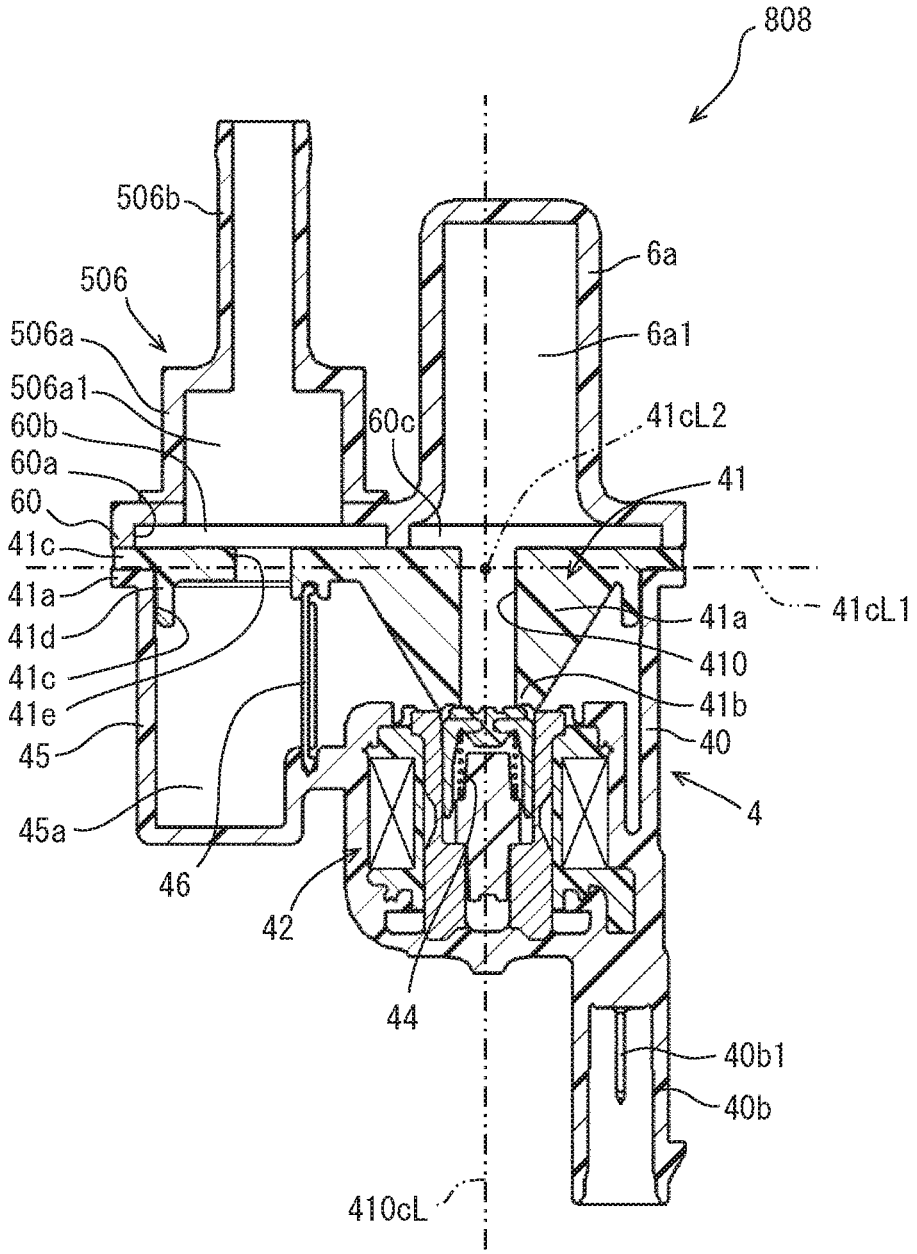
FIG. 16 is a cross-sectional view showing a control valve assembly according to at least one embodiment.

A ninth embodiment will be described with reference to FIGS. 15 and 16. In the following description, explanations for configurations, operations and effects of the ninth embodiment that are the same as those of the first embodiment will be omitted. That is, features of the ninth embodiment different from those of the first embodiment will be described hereafter.

An inflow-outflow member 506 of the fourth embodiment is different from the inflow-outflow member 6 of the first embodiment. As shown in FIGS. 15 and 16, the inflow-outflow member 506 has an inflow portion 506*b* and a cylindrical portion 506*a* through which evaporative fuel flows from the canister 16 into the inflow-outflow member 506, and an outflow portion 61 and an outflow portion 62 through which the evaporative fuel from the purge control valve 4 flows out of the inflow-outflow member 506 toward the engine 22. The cylindrical portion 506*a* and the inflow portion 506*b* has therein an inflow passage through which the evaporative fuel flows toward an in-housing passage of a housing 40. The inflow portion 506*b* is a tubular part that protrudes from the cylindrical portion 506*a* on a side of the inflow-outflow member 506 facing away from the intermediate member 41. The cylindrical portion 506*a* constitutes an inflow portion having therein an inflow passage through which the evaporative fuel flows toward the in-housing passage. The cylindrical portion 506*a* has therein an upstream chamber 506*a*1. The passage in the inflow portion 506*b* communicates with a first passage 41*e* through the upstream chamber 506*a*1. The cylindrical portion 506*a* and a flange 60 may be integrally-fixed separate parts, or may be a single component integrally-molded by using a mold.

In the inflow-outflow member 506, the upstream chamber 506*a*1 is provided between the inflow passage of the inflow-outflow member 506 and the first passage 41*e* of the intermediate member 41. The passage cross-sectional area of the upstream chamber 506*a*1 is larger than that of each of the inflow passage and the first passage 41*e*. Accordingly, pulsation that is likely to occur in a passage leading to the canister 16 at the time of closing the control valve assembly 808 can be reduced. The upstream chamber 506*a*1 is larger in passage cross-sectional area than each of the inflow passage and the first passage 41*e*. Thus, the inflow passage and the first passage 41*e* can be used as a throttle for reducing the pulsation.

Further, a housing chamber 45*a* is provided in the housing 40 such that the first passage 41*e* is present between the housing chamber 45*a* and the upstream chamber 506*a*1. The passage cross-sectional area of the housing chamber 45*a* is larger than that of the first passage 41*e*. Accordingly, a chamber volume that exerts a pulsation reduction effect can be increased by the housing chamber 45*a* and the upstream chamber 506*a*1. The arrangement of the inflow passage, the upstream chamber 506*a*1, the first passage 41*e* and the housing chamber 45*a* produces the pulsation reduction effect.

Tenth Embodiment

Figure 17:
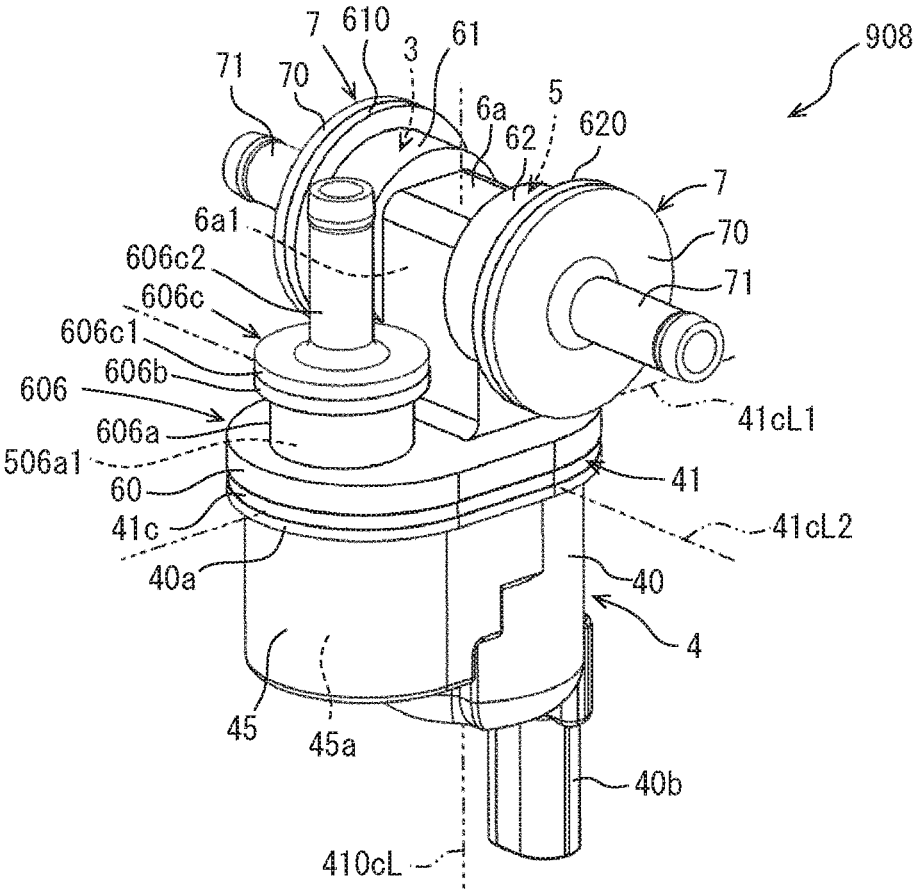
FIG. 17 is a perspective view showing a control valve assembly according to at least one embodiment.

A tenth embodiment will be described with reference to FIG. 17. In the following description, explanations for configurations, operations and effects of the tenth embodiment that are the same as those of the ninth embodiment will be omitted. That is, features of the tenth embodiment different from those of the ninth embodiment will be described hereafter.

The tenth embodiment is different from the ninth embodiment in that a control valve assembly 908 includes a cylindrical portion 606*a* and a tubular portion 606*c*2 which are separate portions and fixed to each other. An inflow-outflow member 606 has the cylindrical portion 606*a* and a tubular member 606*c*, which are separate components and forms an inflow passage and an upstream chamber 506*a*1. The cylindrical portion 606*a* is a portion integrally formed with a flange 60. The cylindrical portion 606*a* constitutes an inflow portion having therein the inflow passage through which evaporative fuel flows toward an in-housing passage. The tubular member 606*c* includes a flange 606*c*1 fixed to a flange 606*b* of the cylindrical portion 606*a* by welding or adhesion, and the tubular portion 606*c*2 extending from the flange 606*c*1. The tubular portion 606*c*2 is connected to a pipe 17 forming an evaporative fuel passage in the evaporative fuel processing system.

Eleventh Embodiment

Figure 18:
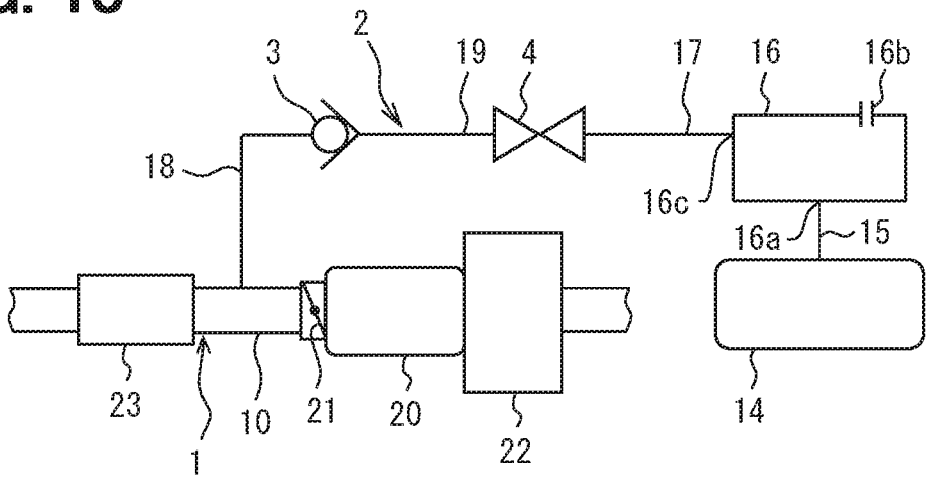
FIG. 18 is a schematic view showing an evaporative fuel processing system which can be equipped with a purge control valve according to at least one embodiment.
Figure 19:
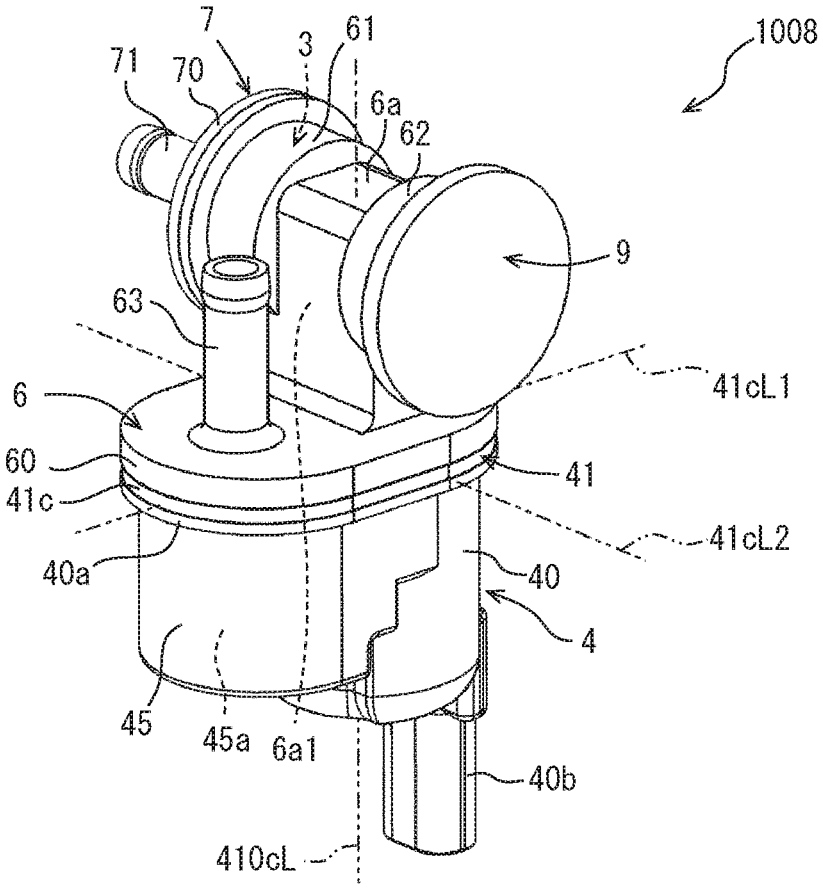
FIG. 19 is a perspective view showing a control valve assembly according to at least one embodiment.

An eleventh embodiment will be described with reference to FIGS. 18 and 19. In the following description, explanations for configurations, operations and effects of the eleventh embodiment that are the same as those of the first embodiment will be omitted. That is, features of the eleventh embodiment different from those of the first embodiment will be described hereafter.

An evaporative fuel processing system and a control valve assembly 1008 of the eleventh embodiment is different from those of the first embodiment. The evaporative fuel processing system shown in FIG. 18 differs from the evaporative fuel processing system of the first embodiment in that the branch passage and the second check valve 5 are not provided. Therefore, in the eleventh embodiment, components included in the control valve assembly 1008 are different from those of the first embodiment. In the control valve assembly 1008 of the eleventh embodiment, a lid 9 is attached to an outflow portion 62. The lid 9 is a member that closes an open end of the outflow portion 62 and blocks a passage extending from a passage in the outflow portion 62 to the outside. The control valve assembly 1008 comprises a first check valve 3 located in the outlet passage formed in the outlet portion. According to this configuration, the control valve assembly 1008 can be mounted on the evaporative fuel processing system of the eleventh embodiment.

Twelfth Embodiment

Figure 20:
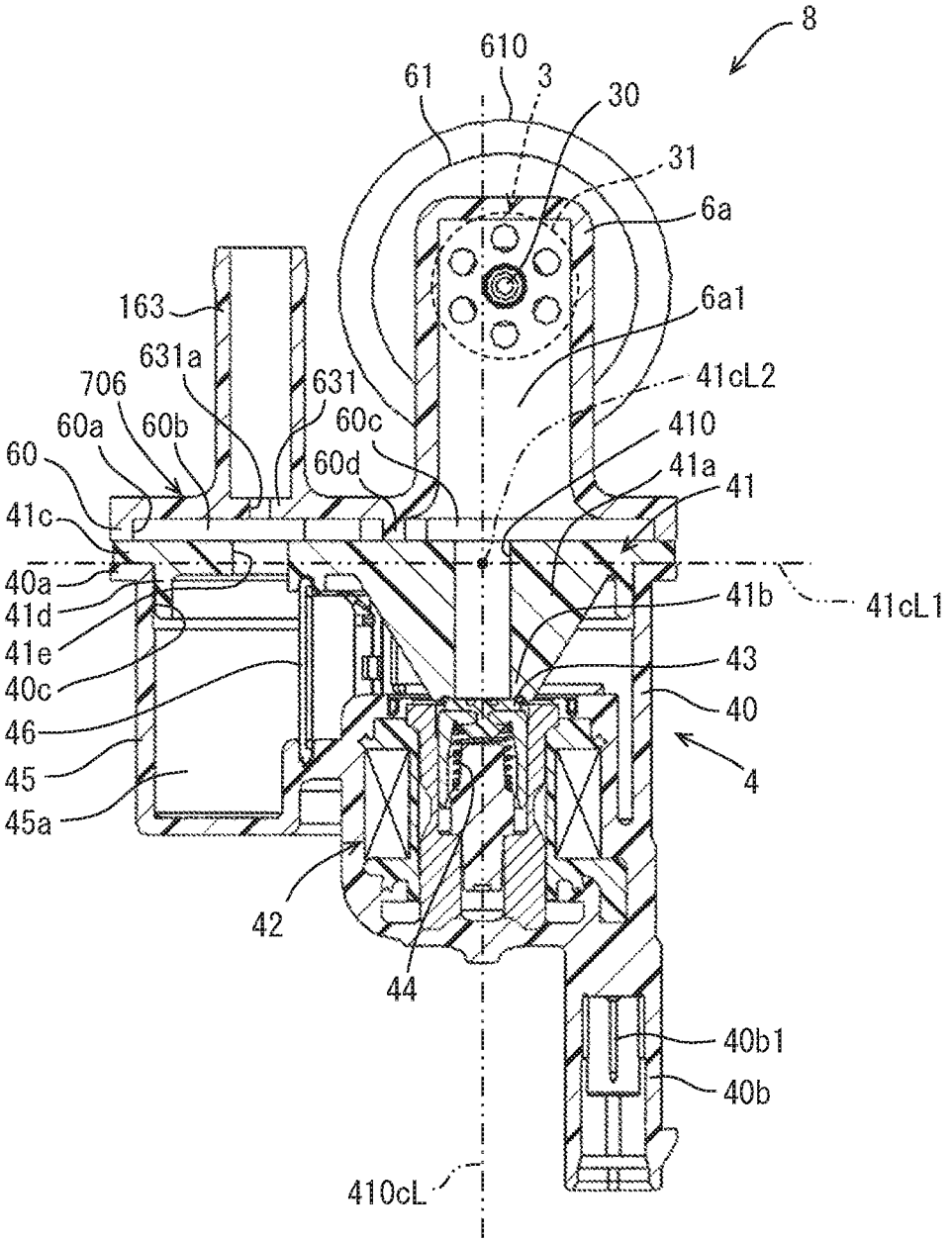
FIG. 20 is a cross-sectional view showing a control valve assembly according to at least one embodiment.

A twelfth embodiment will be described with reference to FIG. 20. In the following description, explanations for configurations, operations and effects of the twelfth embodiment that are the same as those of the first embodiment will be omitted. That is, features of the twelfth embodiment different from those of the first embodiment will be described hereafter.

An inflow passage in an inflow portion 163 of the twelfth embodiment is different from that of the first embodiment. As shown in FIG. 20, the inflow portion 163 includes an annular wall 631 at a downstream end of the inflow portion 163. The annular wall 631 is integrally formed with the inflow portion 163. The inflow portion 163 includes a throttle passage 631*a* which is a through hole formed at the center of the annular wall 631. The throttle passage 631*a* is a passage through which the inflow passage communicates with a first chamber 60*b*. The throttle passage 631*a* is a passage having a smaller passage cross-sectional area than that of the inflow passage or the first chamber 60*b*, and thus serves as a flow resistance to fluid. The passage cross-sectional area of the throttle passage 631*a* is a cross-sectional area obtained by cutting the throttle passage 631*a* along a plane orthogonal to a central axis of the throttle passage 631*a*. Thus, the inflow passage and the first chamber 60*b*, which are lower in flow resistance than the throttle passage 631*a*, are provided on the upstream side and the downstream side of the throttle passage 631*a*, respectively.

The inflow-outflow member 706 of the twelfth embodiment includes the throttle passage 631*a* which is smaller in passage cross-sectional area than each of the inflow passage and the first chamber 60*b*. The inflow passage communicates with the first chamber 60*b* through the throttle passage 631*a*. According to this configuration, the throttle passage 631*a* can provide a pressure loss to a pulsating flow propagating upstream in the valve closed state. Therefore, the pulsating flow is forcibly diffused, narrowed, and then diffused toward upstream. Thus, a control valve assembly 8 can contribute to effective damping of the pulsation. Thus, the control valve assembly 8 can contribute to effectively damping the pulsation only by preparing the inflow-outflow member 706 having the inflow portion 163 including therein the throttle passage 631*a*. The throttle passage 631*a* according to the twelfth embodiment is also applicable to the inflow portion in the second embodiment, the third embodiment, the fourth embodiment, the fifth embodiment, and the eleventh embodiment.

Thirteenth Embodiment

Figure 21:
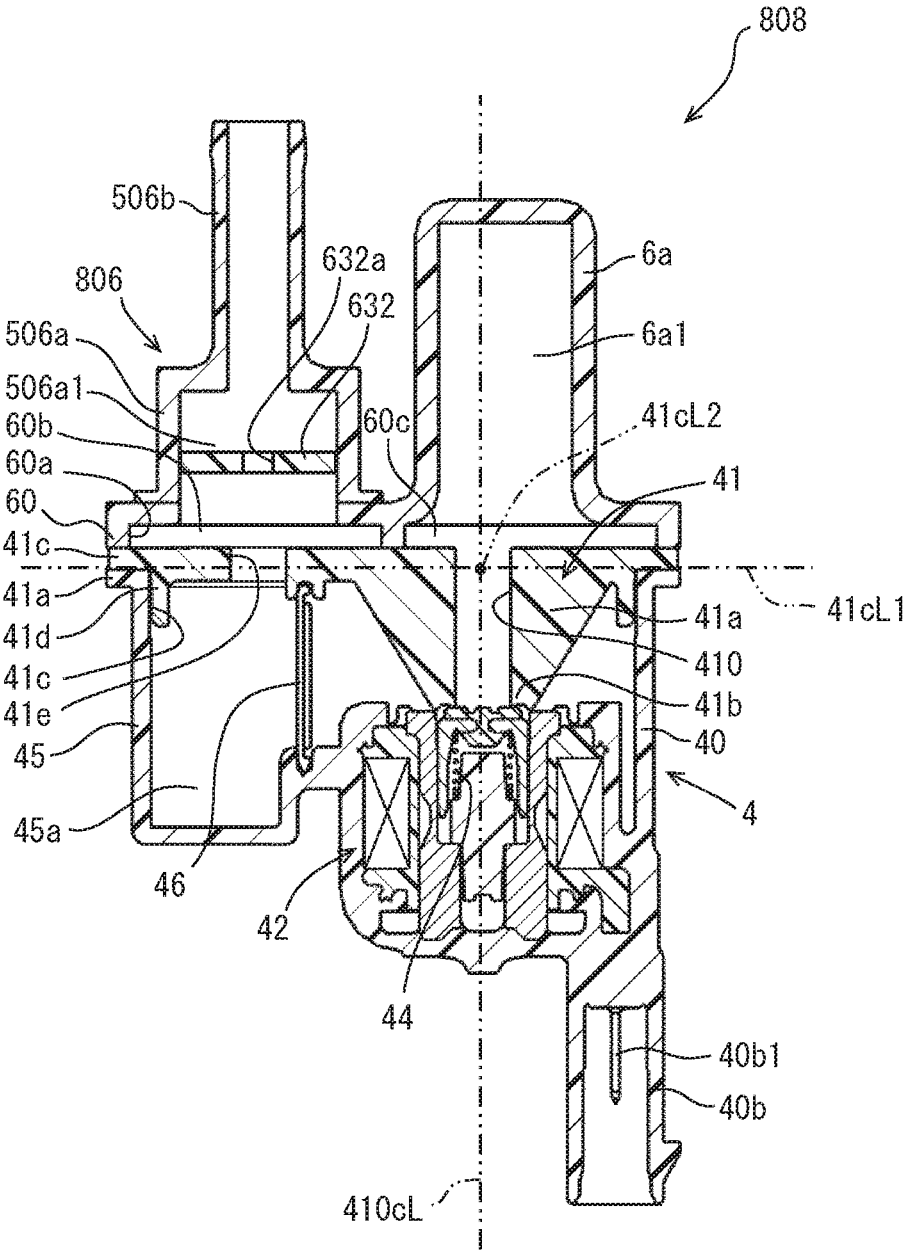
FIG. 21 is a cross-sectional view showing a control valve assembly according to at least one embodiment.

A thirteenth embodiment will be described with reference to FIG. 21. In the following description, explanations for configurations, operations and effects of the thirteenth embodiment that are the same as those of the ninth embodiment will be omitted. That is, features of the thirteenth embodiment different from those of the ninth embodiment will be described hereafter.

An inflow passage in an internal passage of a cylindrical portion 506*a* of the thirteenth embodiment is different from that of the ninth embodiment. As shown in FIG. 21, the cylindrical portion 506*a* includes an annular wall 632 that divides the upstream chamber 506*a*1 inside into the upstream and downstream spaces. The annular wall 632 is a component separate from the cylindrical portion 506*a*, and is joined to an inner wall of the cylindrical portion 506*a* by adhesion, welding or the like. The cylindrical portion 506*a* includes a throttle passage 632*a* which is a through hole formed at the center of the annular wall 632. The throttle passage 632*a* is a passage having a smaller passage cross-sectional area than that of the upstream chamber 506*a*1, and thus serves as a flow resistance to fluid. The passage cross-sectional area of the throttle passage 632*a* is a cross-sectional area obtained by cutting the throttle passage 632*a* along a plane orthogonal to a central axis of the throttle passage 632*a*. Thus, the bisected upstream chamber 506*a*1, which is smaller in flow resistance than the throttle passage 632*a*, is provided on the upstream side and the downstream side of the throttle passage 632*a*.

An inflow-outflow member 806 of the thirteenth embodiment includes the throttle passage 632*a* which is smaller in passage cross-sectional area than the upstream chamber 506*a*1. The upstream space and downstream space of the upstream chamber 506*a*1 communicates with each other through the throttle passage 632*a*. According to this configuration, the throttle passage 632*a* can provide a pressure loss to a pulsating flow propagating upstream in the valve closed state. Therefore, the pulsating flow is forcibly diffused, narrowed, and then diffused toward upstream. Thus, the control valve assembly 808 can contribute to effective damping of the pulsation. Thus, the control valve assembly 808 can contribute to effectively damping the pulsation only by preparing the inflow-outflow member 806 having the cylindrical portion 506*a* including therein the throttle passage 632*a*. The throttle passage 632*a* according to the thirteenth embodiment is also applicable to the cylindrical portion in the sixth embodiment, the seventh embodiment, the eighth embodiment, the ninth embodiment, and the tenth embodiment.

Fourteenth Embodiment

Figure 22:
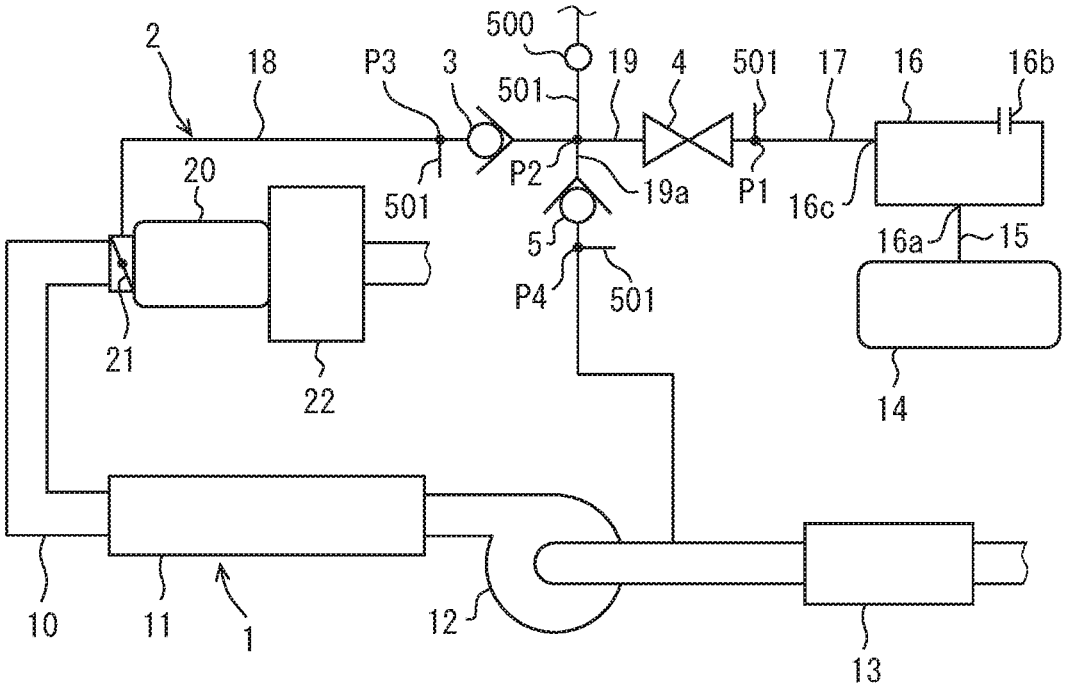
FIG. 22 is a schematic view showing an evaporative fuel processing system which can be equipped with a purge control valve according to at least one embodiment.
Figure 23:
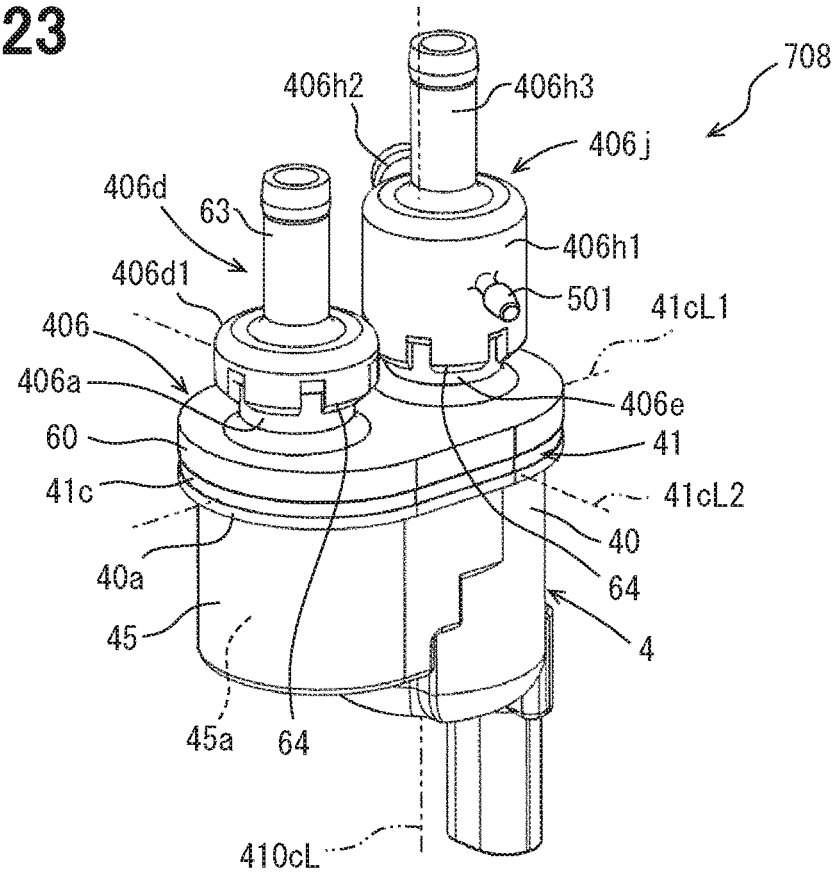
FIG. 23 is a perspective view showing a control valve assembly according to at least one embodiment.

A fourteenth embodiment will be described with reference to FIGS. 22 and 23. In the following description, explanations for configurations, operations and effects of the fourteenth embodiment that are the same as those of the above-described embodiments will be omitted. That is, features of the fourteenth embodiment different from those of the above-described embodiments will be described hereafter.

The fourteenth embodiment is different from the above-describe embodiments in that the control valve assembly includes a pressure detection port for detecting a pressure in the evaporative fuel passage. An example of the pressure detection port is a tubular portion 501. As shown in FIG. 22, the tubular portion 501 is provided in at least one of a first position P1, a second position P2, a third position P3 and a fourth position P4 in the control valve assembly. The first position P1 is upstream of the valve element 43 of the purge control valve 4 in the control valve assembly. The second position P2 is downstream of the valve element 43 and upstream of the check valves in the control valve assembly. The third position P3 is downstream of the first check valve 3 of the purge control valve 4 in the control valve assembly. The fourth position P4 is downstream of the second check valve 5 of the purge control valve 4 in the control valve assembly.

The control valve assembly includes a pressure detector 500 connected to at least one of the positions P1 to P4 and capable of detecting the pressure in the flow passage. For example, the pressure detector 500 can be attached to the control valve assembly through a tube, such as a tube or hose connected to the tubular portion 501. The tubular portion 501 functions as a pressure detection port projecting outward from the control valve assembly.

An example of the control valve assembly in which the tubular portion 501 is provided at the third portion P3 will be described with reference to FIG. 23. A configuration of an engine-side coupler 406*j* of the control valve assembly shown in FIG. 23 differs from that of the eighth embodiment. As shown in FIG. 23, the engine-side coupler 406*j* includes a cylindrical portion 406*h*1 having a tubular portion 501. The tubular portion 501 can be connected to a tube such as a pipe or a hose.

The pressure detector 500 detects a pressure in the tube connected to and communicating with the cylindrical portion 406*h*1, and outputs the pressure to a controller. The pressure detector 500 is also called a pressure sensor. The pressure detector 500 may be configured to directly detect a pressure in the cylindrical portion 406*h*1. The tubular portion 501 functions as a pressure detection port projecting outward from the cylindrical portion 406*h*1. The controller compares the pressure detection value detected by the pressure detector 500 with the normal pressure value stored in advance in a memory to determine whether or not the current state is a malfunction state. Accordingly, a control valve assembly 708 can determine a malfunction condition when a pressure change or pressure value is detected to be different from normal.

Hereinafter, the positions where the tubular portion 501 is provided for each embodiment will be described. In the case of the first to fifth embodiments, the tubular portion 501 can be provided at the first position P1, the second position P2, the third position P3, and the fourth position P4. The first position P1 corresponds to a flat-plate portion that defines the first chamber 60*b* in the inflow-outflow member 6, and the tubular portion 501 can be provided so as to protrude outward similarly to the inflow portion 63. The second position P2 corresponds to the outflow housing 6*a*, and the tubular portion 501 can be provided so as to protrude outward from the outflow housing 6*a*. The third position P3 corresponds to a portion of the outflow portion 61 downstream of the first check valve 3, and the tubular portion 501 can be provided so as to protrude outward from the outflow portion 61. The fourth position P4 corresponds to a portion of the outflow portion 62 downstream of the second check valve 5, and the tubular portion 501 can be provided so as to protrude outward from the outflow portion 62.

In the case of the sixth to eighth embodiments, the tubular portion 501 can be provided at the first position P1 and the second position P2. The first position P1 corresponds to the first cylindrical portion 406*a*, and the tubular portion 501 can be provided so as to protrude outward from the first cylindrical portion 406*a*. The second position P2, similar to the first embodiment, corresponds to the outflow housing 6*a*, and the tubular portion 501 can be provided so as to protrude outward from the outflow housing 6*a*.

In the case of the ninth embodiment, the tubular portion 501 can be provided at the first position P1, the second position P2, the third position P3, and the fourth position P4. The first position P1 corresponds to the cylindrical portion 506*a*, and the tubular portion 501 can be provided so as to protrude outward from the cylindrical portion 506*a*. The second position P2, the third position P3 and the fourth position P4 are the same as those in the case of the first embodiment described above.

In the case of the tenth embodiment, the tubular portion 501 can be provided at the first position P1, the second position P2, the third position P3, and the fourth position P4. The first position P1 corresponds to the cylindrical portion 606*a*, and the tubular portion 501 can be provided so as to protrude outward from the cylindrical portion 606*a*. The second position P2, the third position P3 and the fourth position P4 are the same as those in the case of the first embodiment described above.

In the case of the eleventh embodiment, the tubular portion 501 can be provided at the first position P1, the second position P2 and the third position P3. The first position P1, the second position P2 and the third position P3 are the same as those in the case of the first embodiment described above.

The control valve assembly disclosed in the fourteenth embodiment includes the pressure detection port for detecting a pressure in the evaporative fuel passage. According to this configuration, the pressure detector can be connected to, for example, the control valve assembly 708. Therefore, the number of parts can be reduced and the number of assembling steps can be reduced as compared with the case of being connected to a member other than the control valve assembly.

Other Embodiments

The disclosure of this specification is not limited to the illustrated embodiment. The disclosure encompasses the illustrated embodiments and modifications by those skilled in the art based thereon. The present disclosure is not limited to combinations disclosed in the above-described embodiment but can be implemented in various modifications. The present disclosure can be implemented in various combinations. The disclosure may have additional parts that may be added to the embodiment. The disclosure encompasses omissions of parts and/or elements of the embodiments. The disclosure encompasses replacement or combination of parts and/or elements between one embodiment and another. The disclosed technical scope is not limited to the description of the embodiment. Technical scopes disclosed are indicated by descriptions in the claims and should be understood to include all modifications within the meaning and scope equivalent to the descriptions in the claims.

The control valve assembly disclosed in the specification is not only a device having a configuration in which the housing 40, the intermediate member 41 and the inflow-outflow member are integrally coupled, but a configuration in which the housing 40 and the inflow-outflow member are directly coupled. In the case of this configuration, the housing 40 may include the valve seat 41*b*, or the inflow-outflow member may include the valve seat 41*b*.

The control valve assembly disclosed in the specification is not limited to the examples shown in the above embodiments. Further, the components included in the control valve assembly are not limited to the examples shown in the above embodiments.

According to the comparative example, a flow-control electromagnetic valve is disposed in an evaporative fuel passage extending from a fuel tank to an engine intake pipe through a canister. The flow-control electromagnetic valve includes a housing accommodating an electromagnetic driving portion which drives a valve element. The housing is integrally provided with a fuel inflow pipe extending in a direction orthogonal to the axial direction of the housing.

However, when the flow-control electromagnetic valve is required to be changed in direction or shape of the fuel inflow pipe for installation in the evaporative fuel passage, it is necessary to newly prepare the housing conforming to the specification of the fuel inflow pipe.

In addition, the requirements and specifications of a vehicle vary. Thus, the types and number of parts to be connected to the fuel-control electromagnetic valve and the shapes and orientations of connection ports become various. Therefore, the housing of the purge control valve may be individually designed to meet the specifications.

In contrast, the present disclosure provides a control valve assembly capable of selecting, for example, a direction of a passage connected to a control valve in an evaporative fuel passage.

According to one aspect of the present disclosure, the control valve assembly includes a housing and an inflow-outflow member. The housing accommodates an electromagnetic coil unit which is disposed in an in-housing passage and drives a valve element to open and close the in-housing passage. The inflow-outflow member is coupled to the housing. The inflow-outflow member includes an inflow portion having an inflow passage through which the evaporative fuel flows toward the in-housing passage, and an outflow portion having an outflow passage through which the evaporative fuel from the in-housing passage flows. The outflow passage in the outflow portion and the inflow passage in the inflow portion communicate with each other through the in-housing passage.

The control valve assembly has a configuration coupling the housing and the inflow-outflow member. The housing includes therein the electromagnetic coil unit that drives the valve element. The inflow-outflow member includes the inflow portion and the outflow portion for the evaporative fuel and is separated from the housing. Therefore, just preparing the inflow-outflow member in which the directions or the like of the inflow portion and the outflow portion have been adjusted enables the control valve assembly to meet the specification of a vehicle. Hence, the directions or the like of passages connected to the control valve assembly are selectable.

What is claimed is:

1. A control valve assembly disposed in an evaporative fuel passage through which evaporative fuel desorbed from a canister flows toward an engine, the control valve assembly comprising:

a housing accommodating an electromagnetic coil unit which is disposed in an in-housing passage and drives a valve element to open and close the in-housing passage;

an inflow-outflow member separated from the housing and coupled to the housing, the inflow-outflow member including an inflow portion having an inflow passage through which the evaporative fuel flows toward the in-housing passage, and an outflow portion having an outflow passage through which the evaporative fuel from the in-housing passage flows; and an intermediate member including:

a valve seat for seating of the valve element;

a first passage communicating with the inflow passage; and a second passage communicating with the outflow passage, wherein the intermediate member is interposed between and joined to the housing and the inflow-outflow member, and the outflow passage in the outflow portion and the inflow passage in the inflow portion communicate with each other through the in-housing passage.

2. The control valve assembly according to claim 1, wherein the inflow-outflow member includes an upstream chamber inside the inflow-outflow member and between the inflow passage of the inflow-outflow member and the first passage of the intermediate member, and the upstream chamber is larger than the inflow passage and the first passage in cross-sectional area.

3. The control valve assembly according to claim 2, wherein the housing includes a housing chamber inside the housing such that the first passage is between the upstream chamber and the housing chamber, and the housing chamber is larger than the first passage in cross-sectional area.

4. The control valve assembly according to claim 1, wherein the inflow-outflow member includes a partition separating an outlet of the inflow passage and an inlet of the outflow passage, the partition is positioned in the inflow-outflow member to allow both a first connection state and a second connection state between the housing and the inflow-outflow member depending on a rotational position of the inflow-outflow member with respect to a central axis of the housing, the first connection state is a state where the outlet of the inflow passage connects to a first end side of the in-housing passage while the inlet of the outflow passage connects to a second end side of the in-housing passage, and the second connection state is a state where the inlet of the outflow passage connects to the second end side of the in-housing passage while the outlet of the inflow passage connects to the first end side of the in-housing passage.

5. The control valve assembly according to claim 4, wherein the inflow-outflow member includes a first chamber and a second chamber on different sides of the partition, and the outlet of the inflow passage is open in the first chamber, and the inlet of the outflow passage is open in the second chamber.

6. The control valve assembly according to claim 1, further comprising a tubular member which is a separate component from the inflow-outflow member and attached to the outflow portion.

7. The control valve assembly according to claim 1, further comprising a canister-side coupler and an engine-side coupler which are coupled to the inflow-outflow member, the canister-side coupler and the engine-side coupler are separate from each other and capable of being connected to pipes, the canister-side coupler and the engine-side coupler include an engaging portion which is attachable to and detachable from the inflow-outflow member.

8. The control valve assembly according to claim 7, wherein the engine-side coupler includes two tubular portions capable of being connected to pipes, and the two tubular portions are at positions facing each other.

9. The control valve assembly according to claim 7, wherein the engine-side coupler includes two tubular portions capable of being connected to pipes, and passage axes of the two tubular portions intersect each other.

10. The control valve assembly according to claim 1, further comprising a check valve disposed in the outflow passage of the outflow portion.

11. The control valve assembly according to claim 1, wherein the inflow-outflow member includes a first outflow portion and a second outflow portion as the outflow portion, the control valve assembly further comprising:

a check valve disposed inside the first outflow portion; and a lid attached to the second outflow portion.

12. The control valve assembly according to claim 1, wherein the inflow-outflow member includes a first outflow portion and a second outflow portion as the outflow portion, the control valve assembly further comprising:

a first check valve disposed inside the first outflow portion; and a second check valve disposed inside the second outflow portion.

13. The control valve assembly according to claim 1, wherein the inflow-outflow member includes a first outflow portion and a second outflow portion as the outflow portion, the first outflow portion and the second outflow portion face each other, and the inflow portion extends in a direction intersecting a facing direction in which the first outflow portion and the second outflow portion face each other.

14. The control valve assembly according to claim 1, wherein the inflow-outflow member includes a first outflow portion and a second outflow portion as the outflow portion, the first outflow portion and the second outflow portion extend in directions intersecting with each other, and the inflow portion extends along the first outflow portion or the second outflow portion.

15. The control valve assembly according to claim 1, further comprising a pressure detection port for detecting a pressure in the evaporative fuel passage.

16. A control valve assembly comprising:

a housing defining an in-housing passage therein and accommodating an electromagnetic valve that opens or closes the in-housing passage, a first end of the in-housing passage and a second end of the in-housing passage being open on a same opening side of the housing;

an inflow-outflow member separated from the housing and coupled to the opening side of the housing, the inflow-outflow member defining therein an inflow passage communicating with the first end of the in-housing passage, and an outflow passage communicating with the second end of the in-housing passage; and an intermediate member including:

a valve seat for seating of the electromagnetic valve;

a first passage communicating with the inflow passage; and a second passage communicating with the outflow passage, wherein the intermediate member is interposed between and joined to the housing and the inflow-outflow member.

17. A control valve assembly disposed in an evaporative fuel passage through which evaporative fuel desorbed from a canister flows toward an engine, the control valve assembly comprising:

a housing accommodating an electromagnetic coil unit which is disposed in an in-housing passage and drives a valve element to open and close the in-housing passage; and an inflow-outflow member coupled to the housing, the inflow-outflow member including an inflow portion having an inflow passage through which the evaporative fuel flows toward the in-housing passage, and an outflow portion having an outflow passage through which the evaporative fuel from the in-housing passage flows, wherein the outflow passage in the outflow portion and the inflow passage in the inflow portion communicate with each other through the in-housing passage, the inflow-outflow member includes a first outflow portion and a second outflow portion as the outflow portion, the housing includes an opening and a flange extending radially outward from the opening, and the inflow-outflow member is coupled to the flange of the housing.

* * * * *